US012018686B2

(12) United States Patent
Shin et al.

(10) Patent No.: US 12,018,686 B2
(45) Date of Patent: Jun. 25, 2024

(54) ROTARY COMPRESSOR

(71) Applicant: LG ELECTRONICS INC., Seoul (KR)

(72) Inventors: Jinung Shin, Seoul (KR); SeSeok Seol, Seoul (KR); Sedong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/864,599

(22) Filed: Jul. 14, 2022

(65) Prior Publication Data

US 2023/0125736 A1 Apr. 27, 2023

(30) Foreign Application Priority Data

Oct. 21, 2021 (KR) ..... 10-2021-0141166

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 18/00*** | (2006.01) |
| ***F04C 18/344*** | (2006.01) |

(Continued)

(52) U.S. Cl.

CPC ..... *F04C 18/3445* (2013.01); *F04C 18/3442* (2013.01); *F04C 29/124* (2013.01); *F04C 23/008* (2013.01); *F04C 2210/26* (2013.01); *F04C 2240/50* (2013.01); *F04C 2250/101* (2013.01)

(58) Field of Classification Search

CPC ..... F04C 18/3442; F04C 18/3443; F04C 18/3445; F04C 23/008; F04C 29/12; F04C 29/124; F04C 2210/26; F04C 2240/50; F04C 2250/10; F04C 2250/101

See application file for complete search history.

(56) References Cited

U.S. PATENT DOCUMENTS

2018/0266419 A1 9/2018 Moon et al.
2022/0186731 A1* 6/2022 Heo ..... F04C 29/12

FOREIGN PATENT DOCUMENTS

CN 110836183 2/2020
JP 49-89709 8/1974

(Continued)

OTHER PUBLICATIONS

JP-09250477-A—Fukuda et al.—Rotary Compressor—Sep. 22, 1997—English Machine Translation. (Year: 1997).*

(Continued)

*Primary Examiner* — Theresa Trieu
(74) *Attorney, Agent, or Firm* — KED & ASSOCIATES

(57) ABSTRACT

A rotary compressor is provided that may include a cylinder having an inner peripheral surface; a roller; and a plurality of vanes slidably inserted into the plurality of vane slots to rotate together with the roller, front end surfaces of which come into contact with the inner peripheral surface of the cylinder due to the back pressure to partition the compression space into a plurality of compression chambers. The cylinder may further include a suction flow path for refrigerant that may include a suction port that communicates with the compression space to suction the refrigerant in a lateral direction, and a suction passage disposed in a direction that crosses the suction port to provide communication between the compression space and the suction port.

19 Claims, 14 Drawing Sheets

(51) Int. Cl.
*F04C 29/12* (2006.01)
*F04C 23/00* (2006.01)

(56) References Cited

FOREIGN PATENT DOCUMENTS

| | | | | |
|---|---|---|---|---|
| JP | 09250477 | A | * | 9/1997 |
| JP | 2014-125962 | | | 7/2014 |
| KR | 10-2004-0038331 | | | 5/2004 |
| KR | 10-2191124 | | | 12/2020 |
| WO | WO 2019/045656 | | | 3/2019 |
| WO | WO 2021/045361 | | | 3/2021 |

OTHER PUBLICATIONS

KR20040038331A—Ahn et al.—Suction Gas Guide Apparatus for Enclossed Compressor—May 8, 2004—English Machine Translation. (Year: 2004).*
Korean Office Action issued in Application No. 10-2021-0141166 dated Sep. 27, 2022.
European Search Report issued in Application No. 22180645.8 dated Dec. 7, 2022.

* cited by examiner

ROTARY COMPRESSOR

CROSS-REFERENCE TO RELATED APPLICATION(S)

Pursuant to 35 U.S.C. § 119(a), this application claims the benefit of an earlier filing date of and the right of priority to Korean Patent Application No. 10-2021-0141166, filed in Korea on Oct. 21, 2021, the contents of which are incorporated by reference herein in its entirety.

BACKGROUND

1. Field

A rotary compressor that reduces a surface pressure of a suction section is disclosed herein.

2. Background

A compressor may be divided into a reciprocating compressor, a rotary compressor, and a scroll compressor according to a method of compressing refrigerant. The reciprocating compressor uses a method in which a compression space is disposed between a piston and a cylinder, and the piston linearly reciprocates to compress a fluid, the rotary compressor uses a method of compressing a fluid by a roller that eccentrically rotates inside of a cylinder, and the scroll compressor uses a method in which a pair of spiral scrolls engage and rotate to compress a fluid.

Among them, the rotary compressor may be divided according to a method in which the roller rotates with respect to the cylinder. For example, the rotary compressor may be divided into an eccentric rotary compressor in which a roller rotates eccentrically with respect to a cylinder, and a concentric rotary compressor in which a roller rotates concentrically with respect to a cylinder. In addition, the rotary compressor may be divided according to a method of dividing a compression chamber. For example, it may be divided into a vane rotary compressor in which a vane comes contact with a roller or a cylinder to partition a compression space, and an elliptical rotary compressor in which portion of an elliptical roller comes contact with a cylinder to partition a compression space.

The rotary compressor as described above is provided with a drive motor, a rotational shaft is coupled to a rotor of the drive motor, and a rotational force of the drive motor is transmitted to a roller through the rotational shaft to compress refrigerant.

(Japanese Patent Application Laid-Open No. 2014-125962 (hereinafter "Patent Document 1"), which is hereby incorporated by reference, discloses a gas compressor including a rotor, a cylinder having an inner peripheral surface surrounding an outer peripheral surface of the rotor, a plurality of plate-shaped vanes slidably inserted into a vane groove disposed in the rotor, and two side blocks respectively blocking both ends of the rotor and the cylinder. The vanes come into contact with the inner peripheral surface of the cylinder to define a plurality of compression chambers with front ends of the vanes, and a contour shape of the inner peripheral surface of the cylinder is set such that each of those defined compression chambers performs only one cycle of suction, compression, and discharge of gas during one rotation of the rotor.

As in Patent Document 1, a vane-type compressor with a low-pressure structure has a structure in which refrigerant gas is suctioned into the compression chamber by passing through (i) an inlet port, and (ii) a suction port in a main bearing. In particular, in Patent Document 1, the suction port has a shape in which the suction port is disposed in the main bearing, and the refrigerant gas is suctioned into both upper and lower portions of the cylinder. In addition, Patent Document 1 discloses a structure in which a lower portion of the cylinder defines a flow path connected to a sub bearing through the cylinder from the suction port of the main bearing. In most vane-type compressors, the suction port has such a shape.

On the other hand, a suction port of a concentric compressor has a structure in which the suction port is defined on a side surface of the cylinder, and the refrigerant gas directly flows into the compression chamber through the suction port on the side surface of the cylinder. Such structure of the concentric compressor is a high-pressure structure different from a vane compressor in the related art, and rather has the same suction structure as that of a rotary compressor.

The structure of the concentric compressor is disadvantageous in terms of vane surface pressure as the suction port is defined on the side of the cylinder, which may cause a reliability problem. In particular, in the case of the existing suction port, it is defined on a side surface of the cylinder to form a large vane contact force and a large surface pressure, thereby causing a reliability problem, such as wear at the suction port. Therefore, in the structure of the concentric compressor, it is required to partially change a suction structure of the cylinder so as to develop a rotary compressor having a structure capable of reducing a surface pressure applied to the vane, thereby improving efficiency and reliability of the compressor.

BRIEF DESCRIPTION OF THE DRAWINGS

Embodiments will be described in detail with reference to the following drawings in which like reference numerals refer to like elements, and wherein.

DETAILED DESCRIPTION

Figure 1:
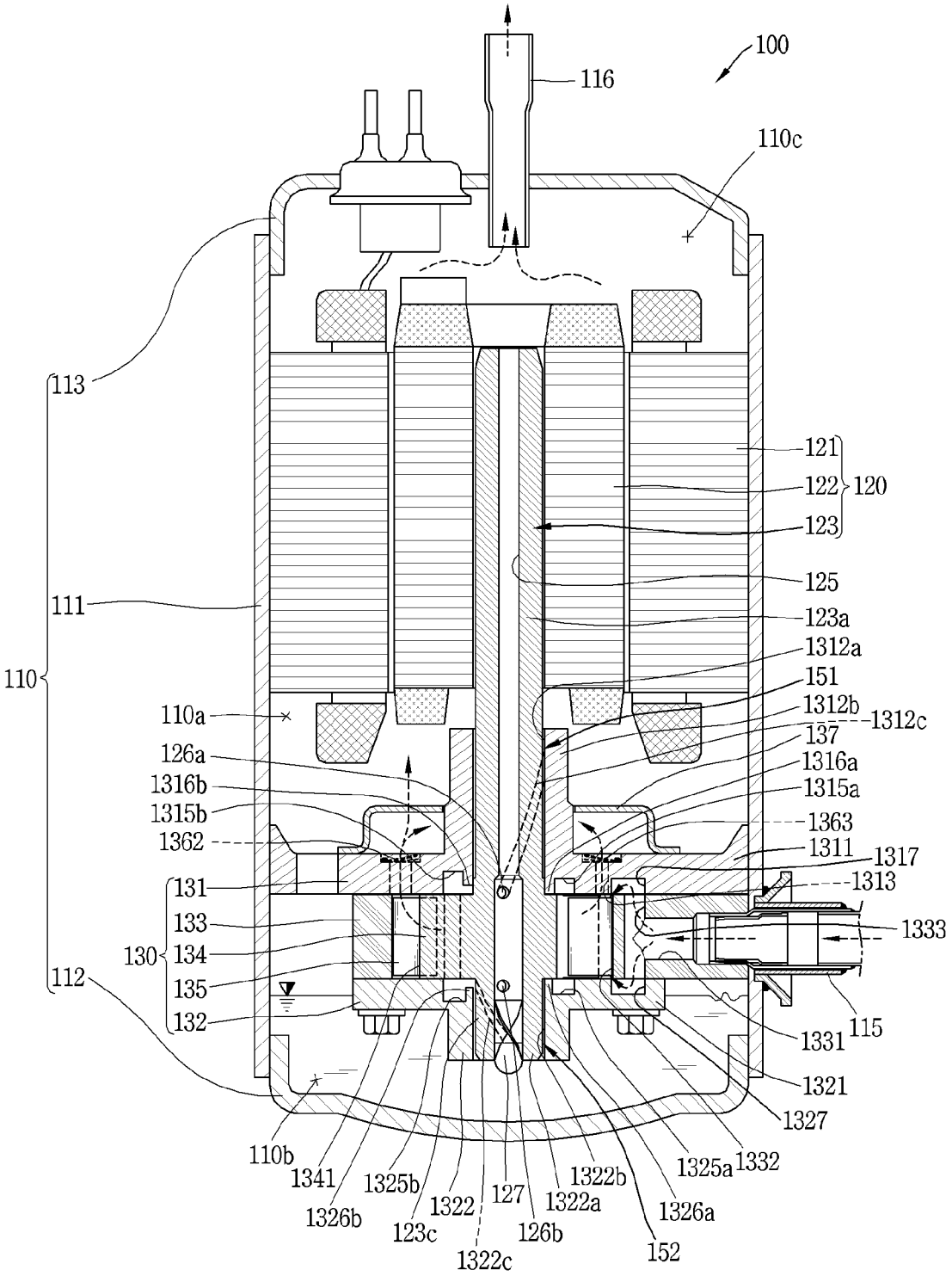
FIG. 1 is a longitudinal cross-sectional view showing a rotary compressor of according to an embodiment.

Hereinafter, the same or similar reference numerals are assigned to the same or similar components in different embodiments, and redundant description thereof has been omitted.

Further, structure applied to any one embodiment may be also applied in the same manner to another embodiment as long as they do not structurally or functionally contradict each other even in different embodiments.

A singular representation may include a plural representation unless it represents a definitely different meaning from the context.

In describing an embodiment disclosed herein, moreover, detailed description has been omitted when specific description for publicly known technologies to which embodiments pertain is judged to obscure the gist.

The accompanying drawings are provided only for a better understanding of the embodiments disclosed herein and are not intended to limit technical concepts disclosed herein, and therefore, it should be understood that the accompanying drawings include all modifications, equivalents, and substitutes within the concept and technical scope.

Figure 2:
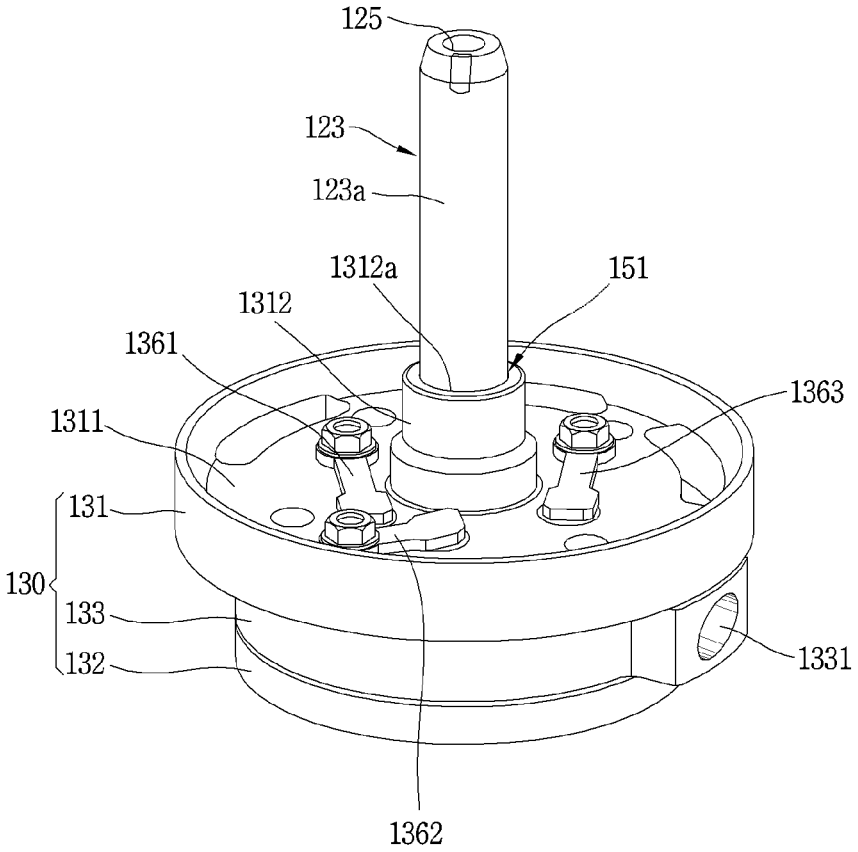
FIG. 2 is a perspective view of a compression unit of the rotary compressor of FIG. 1.
Figure 3:
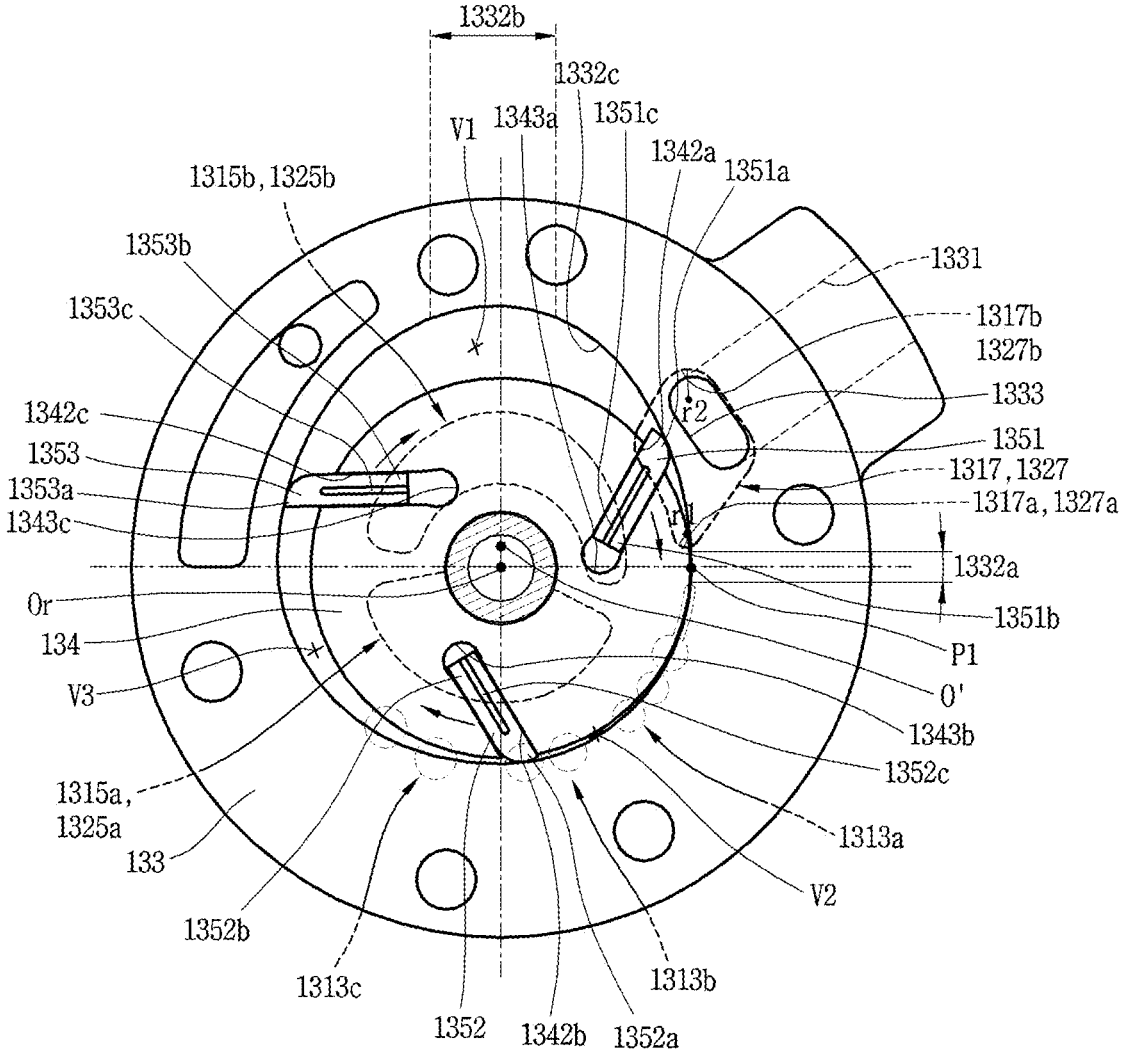
FIG. 3 is a transverse cross-sectional view of the compression unit of the rotary compressor of FIG. 1.

FIG. 1 is a longitudinal cross-sectional view of a rotary compressor according to an embodiment. FIG. 2 is a perspective view of a compression unit of the rotary compressor of FIG. 1. FIG. 3 is a transverse cross-sectional view of the compression unit of the rotary compressor of FIG. 1 FIG. 4 is an exploded perspective view of the compression unit of the rotary compressor of FIG. 1.

Hereinafter, rotary compressor 100 according to an embodiment will be described with reference to FIGS. 1 to 4.

The rotary compressor 100 according to an embodiment may be a vane rotary compressor 100. In addition, the rotary compressor 100 according to an embodiment may reduce a surface pressure between suction ports 1331 in a vane-type compressor for vehicles and air conditioning to improve reliability and overcome mechanical loss.

Figure 4:
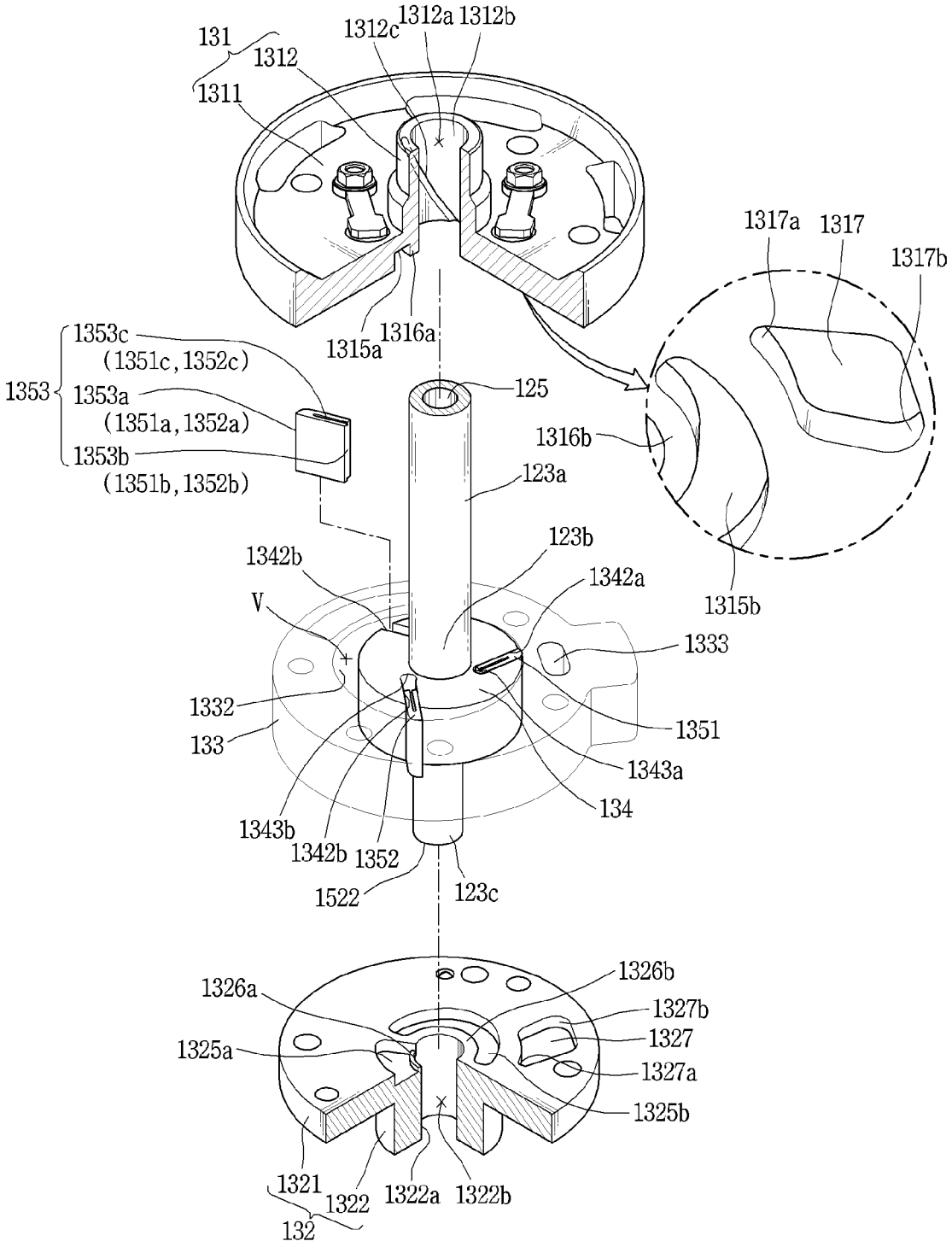
FIG. 4 is an exploded perspective view of the compression unit of the rotary compressor of FIG. 1.

Referring to FIGS. 3 and 4, the rotary compressor 100 according to an embodiment may include a cylinder 133, a roller 134, and a plurality of vanes 1351, 1352, 1353. The cylinder 133 may be configured with an annular inner peripheral surface to define a compression space V. In addition, the cylinder 133 may be provided with a suction flow path for refrigerant. The suction flow path may include a suction port 1331 and a suction passage 1333, and the suction port 1331 may communicate with the compression space V to suction refrigerant and provide it to the compression space V.

The refrigerant suctioned into the suction port 1331 may be a refrigerant gas, and may be separated into liquid refrigerant and gas refrigerant in an accumulator, and the separated gas refrigerant may flow into the compression space V through the suction port 1331 of the cylinder 133, and the liquid refrigerant may flow back into an evaporator.

Further, the suction passage 1333 may be disposed in a direction crossing the suction port 1331, and may be disposed to allow communication between the compression space V and the suction port 1331. The refrigerant flows into the compression space V through the suction port 1331 and the suction passage 1333.

The detailed structure of the suction passage 1333 will be described hereinafter.

An inner peripheral surface 1332 of the cylinder 133 may be defined in an elliptical shape, and the inner peripheral surface 1332 of the cylinder 133 according to this embodiment may be combined such that a plurality of ellipses, for example, four ellipses having different major and minor ratios have two origins to define an asymmetric elliptical shape, and detailed description of a shape of the inner peripheral surface of the cylinder 133 will be described hereinafter.

The roller 134 may be rotatably provided in the compression space V of the cylinder 133. In addition, the roller 134 may include a plurality of vane slots 1342*a*, 1342*b*, 1342*c* with a predetermined interval therebetween along an outer peripheral surface of the roller 134. Further, the compression space V may be defined between an inner periphery of the cylinder 133 and an outer periphery of the roller 134.

That is, the compression space V may be a space defined between the inner peripheral surface of the cylinder 133 and the outer peripheral surface of the roller 134. In addition, the compression space V may be divided into spaces as many as the number of vanes 1351, 1352, 1353 by the plurality of vanes 1351, 1352, 1353.

For example, referring to FIG. 3, an example is shown in which the compression space V is partitioned into a first compression space V1 provided at a side of discharge ports 1313*a*, 1313*b*, 1313*c*, a second compression space V2 provided at a side of the suction port 1331, and a third compression space V3 provided between the side of the suction port 1331 and the side of the discharge ports 1313*a*, 1313*b*, 1313*c* by the three vanes 1351, 1352, 1353. The vanes 1351, 1352, 1353 are slidably inserted into the vane slots 1342*a*, 1342*b*, 1342*c*, and are configured to rotate together with the roller 134. In addition, a back pressure is provided at a rear end of the vane 1351, 1352, 1353 to allow a front end surfaces 1351*a*, 1352*a*, 1353*a* of the vane 1351, 1352, 1353 to come into contact with the inner periphery of the cylinder 133.

In this embodiment, the plurality of vanes 1351, 1352, 1353 is provided to define a multi-back pressure structure, and the front end surfaces 1351*a*, 1352*a*, 1353*a* of the plurality of vanes 1351, 1352, 1353 come into contact with the inner periphery of the cylinder 133, thereby allowing the compression space V to be partitioned into the plurality of compressed spaces V1, V2, V3. An example in which three vanes 1351, 1352, 1353 are provided is shown in FIG. 3, thereby allowing the compression space V to be partitioned into the three compression spaces V1, V2, V3.

In the rotary compressor 100, high-pressure refrigerant may be accommodated between one of the plurality of vanes 1351, 1352, 1353 and the inner periphery of the cylinder 133, and a predetermined back pressure may be maintained such that the front end surfaces 1351*a*, 1352*a*, 1353*a* of the vanes 1351, 1352, 1353 come into contact with the inner periphery of the cylinder 133 until the high-pressure refrigerant is bypassed to the suction port 1331. The predetermined back pressure may be understood as a discharge back pressure that enables the high-pressure refrigerant to be discharged into an inner space of a casing 110 through the discharge ports 1313*a*, 1313*b*, 1313*c* of the compression space V. In addition, a time point at which the high-pressure refrigerant is bypassed to the suction port 1331 may be understood as a "suction start time point", which is a time point at which suction starts.

Hereinafter, the rotary compressor 100 according to an embodiment will be described in more detail.

Referring to FIG. 1, the rotary compressor 100 according to an embodiment may further include casing 110, a drive motor 120 provided inside of the casing 110 to generate rotational power, and a main bearing 131 and a sub bearing 132 provided at both ends of the cylinder 133 and disposed to be spaced apart from each other, respectively, to define both surfaces of the compression space V, respectively. The drive motor 120 may be provided in an upper inner space 110*a* of the casing 110, and the compression unit 130 in a lower inner space 110*b* of the casing 110, respectively, and the drive motor 120 and the compression unit 130 may be connected by a rotational shaft 123.

The casing 110, which is a portion constituting an exterior of the compressor, may be divided into a vertical or horizontal type depending on an aspect of installing the compressor. The vertical type has a structure in which the drive motor 120 and the compression unit 130 are disposed at upper and lower sides along an axial direction, and the horizontal type has a structure in which the drive motor 120 and the compression unit 130 are disposed at left and right or lateral sides. The casing 110 according to an embodiment will be mainly described with respect to the vertical type, but it is not excluded that the casing 110 may also be applied to the horizontal type.

The casing 110 may include an intermediate shell 111 defined in a cylindrical shape, a lower shell 112 that covers a lower end of the intermediate shell 111, and an upper shell 113 that covers an upper end of the intermediate shell 111. The drive motor 120 and the compression unit 130 may be inserted into and fixedly coupled to the intermediate shell 111, and a suction pipe 115 may pass therethrough to be directly connected to the compression unit 130. The lower shell 112 may be sealingly coupled to a lower end of the intermediate shell 111, and a storage oil space 110*b* in which oil to be supplied to the compression unit 130 may be stored may be disposed below the compression unit 130. The upper shell 113 may be sealingly coupled to an upper end of the intermediate shell 111, and an oil separation space 110*c* may be disposed above the drive motor 120 to separate oil from refrigerant discharged from the compression unit 130.

The drive motor 120, which is a portion constituting an electric motor unit, provides power to drive the compression unit 130. The drive motor 120 may include a stator 121, a rotor 122, and the rotational shaft 123. The stator 121 may be fixedly provided inside of the casing 110, and may be, for example, press-fitted and fixed to an inner peripheral surface of the casing 110 by a method, such as shrink fitting, for example. For example, the stator 121 may be press-fitted and fixed to an inner peripheral surface of the intermediate shell 111.

The rotor 122 may be rotatably inserted into the stator 121, and the rotational shaft 123 may be press-fitted and coupled to a center of the rotor 122. Accordingly, the rotational shaft 123 may rotate concentrically together with the rotor 122.

An oil flow path 125 may be defined in a hollow hole shape at a center of the rotational shaft 123, and oil through holes 126*a*, 126*b* may be disposed to pass therethrough toward an outer peripheral surface of the rotational shaft 123 in a middle of the oil flow path 125. The oil through holes 126*a*, 126*b* may include a first oil through hole 126*a* belonging to a range of a main bush portion 1312 and a second oil through hole 126*b* belonging to a range of a sub bearing portion 1322, which will be described hereinafter. Each of the first oil through hole 126*a* and the second oil through hole 126*b* may be configured as one or a plurality. This embodiment shows an example that is includes a plurality of oil through holes.

An oil pickup 127 may be provided in the middle or at a lower end of the oil flow path 125. For example, the oil pickup 127 may include one of a gear pump, a viscous pump, or a centrifugal pump. This embodiment shows an example in which a centrifugal pump is applied. Accordingly, when the rotational shaft 123 rotates, oil filled in the oil storage space 110*b* of the casing 110 may be pumped by the oil pickup 127, and the oil may be suctioned up along the oil flow path 125 and then supplied to a sub bearing surface 1322*b* of the sub bearing portion 1322 through the second oil through hole 126*b*, and to a main bearing surface 1312*b* of the main bush portion 1312 through the first oil through hole 126*a*.

Further, the rotational shaft 123 may be integrally formed with the roller 134 or the roller 134 may be press-fitted and post-assembled thereto. In this embodiment, an example in which the roller 134 is integrally formed with the rotational shaft 123 will be mainly described, but the roller 134 will be described again hereinafter.

In the rotational shaft 123, a first bearing support surface (not shown) may be disposed at an upper half portion of the rotational shaft 123 with respect to the roller 134, that is, between a main shaft portion 123*a* press-fitted into the rotor 122 and a main bearing portion 123*b* that is provided between the main shaft portion 123*a* and sub bearing portion 123*c*, and a second bearing support surface (not shown) may be disposed at a lower half portion of the rotational shaft 123 with respect to the roller 134, that is, on the rotational shaft 123 at a lower end of the sub bearing 132. The first bearing support surface constitutes a first axial support portion 151 together with a first shaft support surface (not shown) described hereinafter, and the second bearing support surface constitutes a second shaft support portion 152 together with a second shaft support surface (not shown) described hereinafter. The first bearing support surface and the second bearing support surface will be described hereinafter together with first axial support portion 151 and second axial support portion 152.

The main bearing 131 and the sub bearing 132 may be respectively provided at both ends of the cylinder 133. The main bearing 131 and the sub bearing 132 may be disposed to be spaced apart from each other to constitute both surfaces of the aforementioned compression space V, respectively.

For example, referring to FIGS. 1, 2 and 4, an example is shown in which the main bearing 131 is provided at an upper end of the cylinder 133 to define an upper surface of the compression space V, and the sub bearing 132 is provided at a lower end of the cylinder 133 to define a lower surface of the compression space V.

Figure 5:
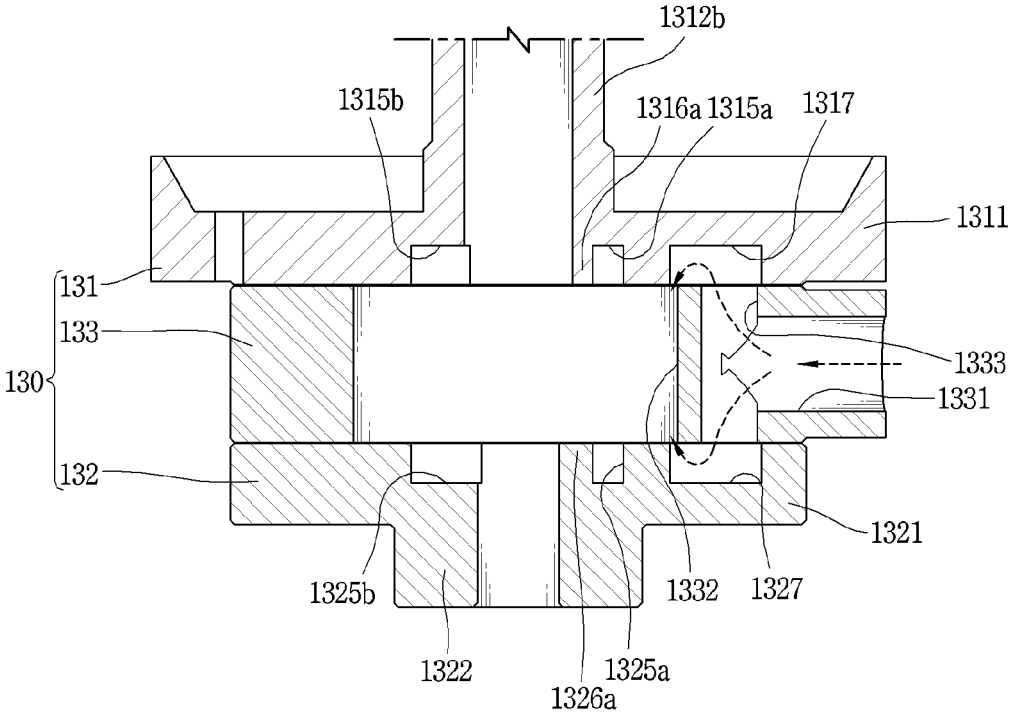
FIG. 5 is a longitudinal cross-sectional view of the compression unit of the rotary compressor of FIG. 1.
Figure 6:
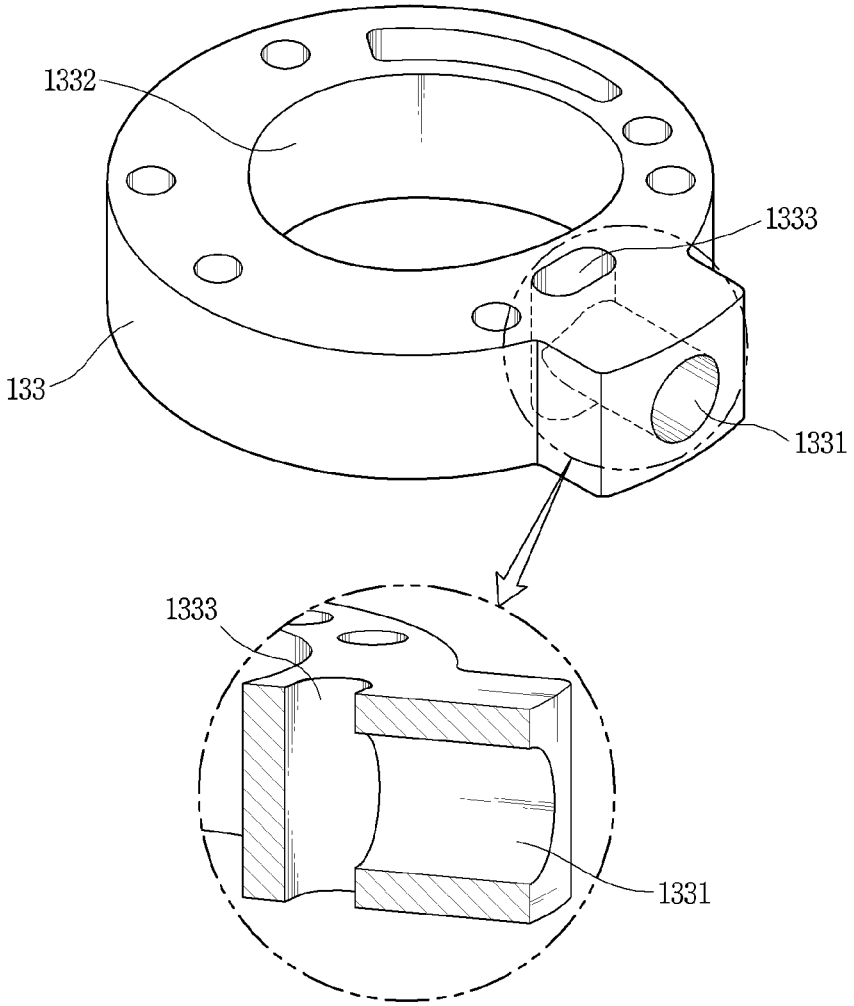
FIG. 6 is a perspective view showing an example of a cylinder of the rotary compressor according to an embodiment.

FIG. 5 is a longitudinal cross-sectional view of a compression unit of the rotary compressor according to an embodiment FIG. 6 is a perspective view showing an example of a cylinder of the rotary compressor according to an embodiment.

The suction passage 1333 may communicate between the compression space V and the suction port 1331, and may be disposed in a direction crossing the suction port 1331. Referring to FIGS. 5 and 6, an example is shown in which the suction passage 1333 is disposed to pass through upper and lower surfaces of the cylinder 133 in parallel with a vertical direction, and has an elliptical cross section.

In addition, as will be described hereinafter with respect to FIGS. 13 and 14, the suction passage 1333 may not be disposed in parallel with a vertical direction, but rather, may include first and second suction passages 1333*a*, 1333*b* in a direction intersecting the vertical direction, which will be described hereinafter. As shown in FIGS. 5 and 6, as the suction passage 1333 is disposed in the vertical direction, instead of a structure in which refrigerant is directly suctioned from a lateral direction, a suction flow path through which the refrigerant flows into the compression space V in upper and lower directions of the cylinder 133 is provided.

Figure 7:
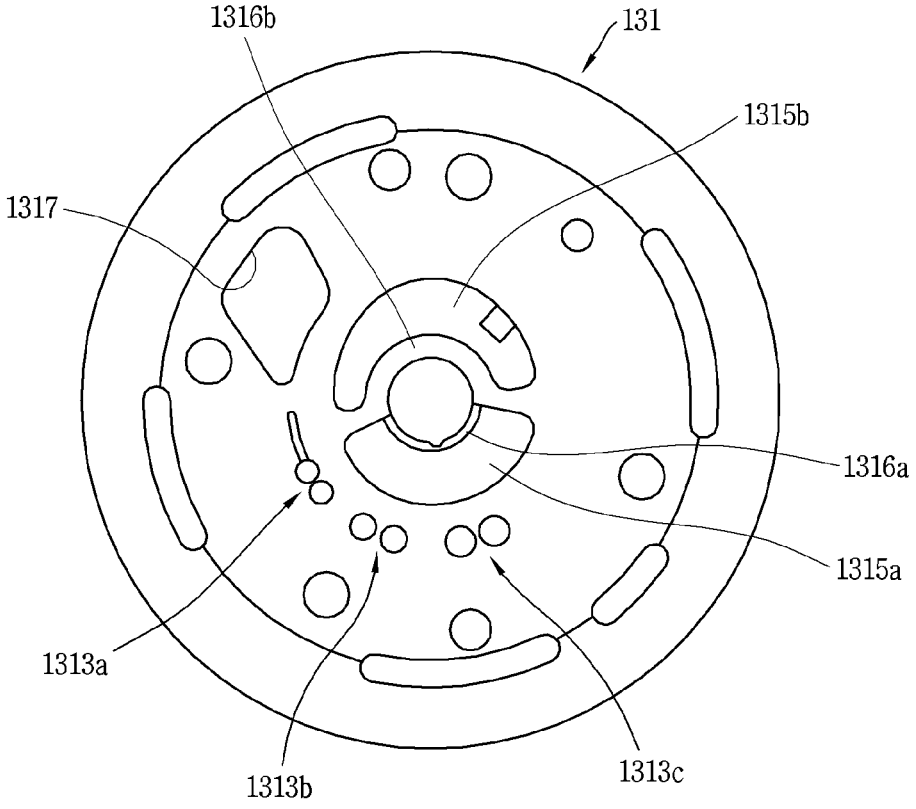
FIG. 7 is a plan view showing a bottom surface of a main bearing of the rotary compressor according to an embodiment.
Figure 8:
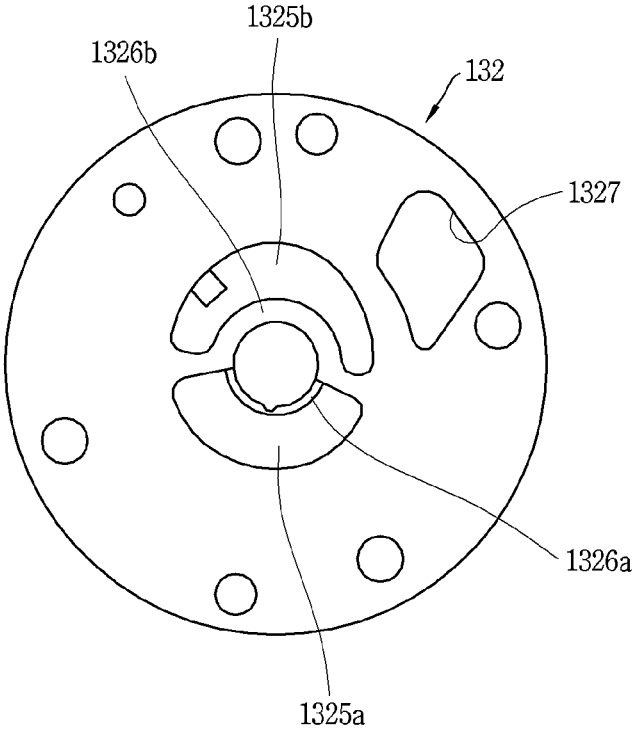
FIG. 8 is a plan view showing an upper surface of the main bearing of the rotary compressor according to an embodiment.

FIG. 7 is a plan view showing a bottom surface of a main bearing of the rotary compressor according to an embodiment. FIG. 8 is a plan view showing an upper surface of the main bearing of the rotary compressor according to an embodiment.

With reference to FIGS. 7 and 8, a suction guide portion 1317, 1327 disposed on at least one of the main bearing 131 or the sub bearing 132 will be described. The suction guide portion (suction guide) 1317, 1327 may be disposed on at least one of the main bearing 131 or the sub bearing 132. The suction guide portion 1317, 1327 may be concavely defined in the main bearing 131 or the sub bearing 132 to provide communication between the suction passage 1333 and the compression space V so as to accommodate and guide refrigerant that has passed through the suction passage 1333 to the compression space V.

Referring to FIGS. 1, 2 and 4, an example is shown in which the main bearing 131 is provided at upper end of the cylinder 133 to define an upper surface of the compression space V, and the sub bearing 132 is provided at a lower end of the cylinder 133 to define a lower surface of the compression space V.

The suction guide portion 1317, 1327 may include main suction guide portion (main suction guide) 1317. The main suction guide portion 1317 may be concavely defined to provide communication between the suction passage 1333 and the compression space V in the main bearing 131. Further, the main suction guide portion 1317 may accommodate and provide refrigerant that has passed through the suction passage 1333 to the compression space V to flow in an upward direction.

Referring to FIGS. 3, 4 and 7, an example of the main suction guide portion 1317 in a rhombus shape is shown, but the shape of the main suction guide portion 1317 may not be necessarily limited to this structure, and any structure may be employed as long as it is a structure capable of accommodating refrigerant that has passed through the suction passage 1333 and guiding its flow to provide the refrigerant to the compression space V.

However, the main suction guide portion 1317 must communicate with the suction passage 1333 and the compression space V, respectively, and is configured so as not to communicate with the outside to constitute a sealing structure. In addition, the main suction guide portion 1317 must have a structure capable of accommodating all or portion of an upper end of the suction passage 1333.

Referring to FIGS. 3 and 4, the main suction guide portion 1317 may include one or a first side portion 1317*a* of the main suction guide portion 1317 that extends toward a proximal point P1, and the other or a second side portion 1317*b* disposed at an opposite side of the one side portion 1317*a*. Further, referring to FIG. 3, an example is shown in which the one side portion 1317*a* of the main suction guide portion 1317 is disposed to be longer than the other side portion 1317*b*. Accordingly, the main suction guide portion 1317 constitutes an asymmetric structure. The one side portion 1317*a* of the main suction guide portion 1317 may be disposed to be longer than the other side portion 1317*b*, and extend toward the proximal point P1 to further improve suction efficiency. Further, as shown in FIG. 3, a radius $r_2$ of the second side portion 1317*b* may be larger than a radius $r_1$ of the first side portion 1317*a*.

The suction guide portions 1317, 1327 may further include sub suction guide portion (sub suction guide) 1327. The sub suction guide portion 1327 may be concavely defined to provide communication between the suction passage 1333 and the compression space V in the sub bearing 132. In addition, the sub suction guide portion 1327 may accommodate refrigerant that has passed through the suction passage 1333 to flow in a downward direction so as to be provided to the compression space V.

Referring to FIG. 8, an example of the sub suction guide portion 1327 in a rhombus shape is shown, but the shape of the sub suction guide portion 1327 may not be necessarily limited to this structure, and any structure may be employed as long as it is a structure capable of accommodating refrigerant that has passed through the suction passage 1333 and guiding its flow to provide the refrigerant to the compression space V. However, the sub suction guide portion 1327, similarly to the main suction guide portion 1317 described above, must communicate with the suction passage 1333 and the compression space V, respectively, and is configured so as not to communicate with the outside to constitute a sealing structure. In addition, the sub suction guide portion 1327 must have a structure capable of accommodating all or part or portion of a lower end of the suction passage 1333.

Referring to FIGS. 3 and 4, the sub suction guide portion 1327 may include one or a first side portion 1327*a* of the sub suction guide portion 1327 disposed toward a proximal point P1, and the other or a second side portion 1327*b* disposed at an opposite side of the one side portion 1327*a*. Further, referring to FIG. 3, an example is shown in which the one side portion 1327*a* of the sub suction guide portion 1327 is disposed to be longer than the other side portion 1327*b*. Accordingly, the sub suction guide portion 1327 constitutes an asymmetric structure. The one side portion 1327*a* of the sub suction guide portion 1327 is disposed to be longer than the other side portion 1327*b*, and extends toward the proximal point P1 to further improve suction efficiency.

The one side portion 1317*a*, 1327*a* and the other side portion 1317*b*, 1327*b* of the aforementioned suction guide portion 1317, 1327 are provided in at least one of the main suction guide portion 1317 or the sub suction guide portion 1327. That is, both the main suction guide portion 1317 and the sub suction guide portion 1327 may include the one side portion 1317*a*, 1327*a* and the other side portion 1317*b*, 1327*b*, or the main suction guide portion 1317 or the sub suction guide portion 1317 may include one side portion 1317*a*, 1327*a* and the other side portion 1317*b*, 1327*b*.

Referring to FIGS. 7 and 8, an example is shown in which the main suction guide portion 1317 and the sub suction guide portion 1327 are defined in shapes corresponding to each other.

As described above, a suction flow path of refrigerant through which the refrigerant flows into the compression space V of the cylinder 133 in a direction in which the main bearing 131 and the sub bearing 132 are disposed from a side surface of the cylinder 133 by a structure in which the main suction guide portion 1317 and the sub suction guide portion 1327 are disposed on the main bearing 131 and the sub bearing 132, respectively. In particular, the suction flow path of refrigerant constitutes a flow path that communicates from the suction portion and the suction passage 1333 of the cylinder 133 to the main suction guide portion 1317 of the main bearing 131 and the sub suction guide portion 1327 of the sub bearing 132.

Figure 9:
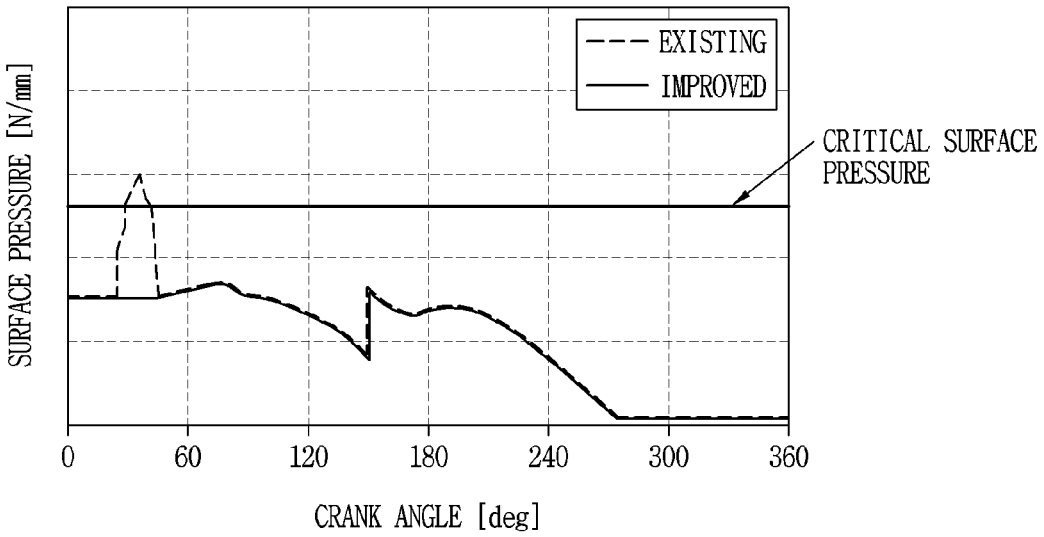
FIG. 9 is a graph showing a comparison between efficiencies of the related art and embodiments.

FIG. 9 is a graph showing a comparison between efficiencies of the related art and embodiments, and as shown in FIG. 9, there exists a point exceeding a critical surface pressure of the suction port 1331 between crank angles of 0 and 60 degrees due to an inflow of refrigerant gas through the lateral suction port 1331 in the case of the rotary compressor 100 in the related art, but the critical surface pressure of the suction port 1331 is not exceeded due to a decrease in surface pressure at the suction port 1331 between 0 and 60 degrees in the rotary compressor according to embodiments.

The suction passage 1333 may be disposed to pass through upper and lower surfaces of the cylinder 133 in parallel with a vertical direction. Referring to FIGS. 5 and 6, an example is shown in which the suction passage 1333 is disposed to pass through the upper and lower surfaces of the cylinder 133. In FIG. 6, an example is shown in which the suction passage 1333 has an elliptical cross section.

Figure 10:
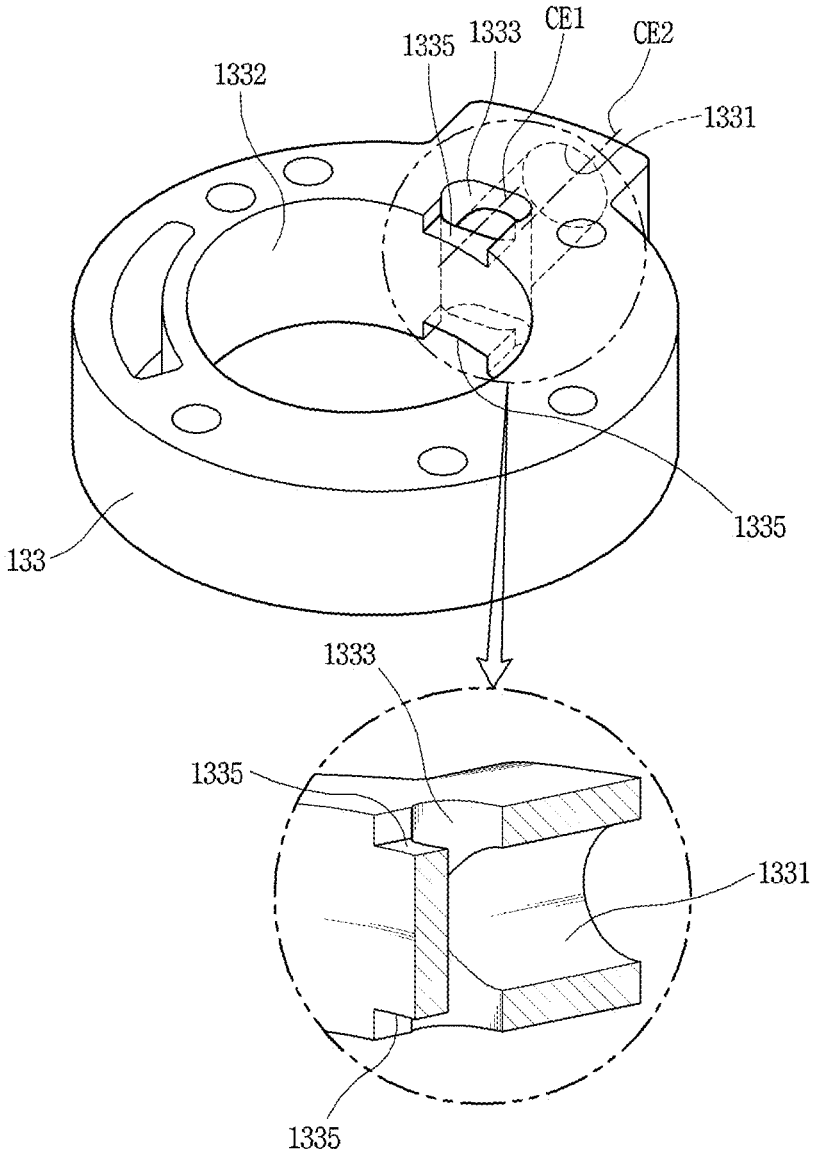
FIG. 10 is a perspective view showing another example of a cylinder of the rotary compressor according to an embodiment.
Figure 11:
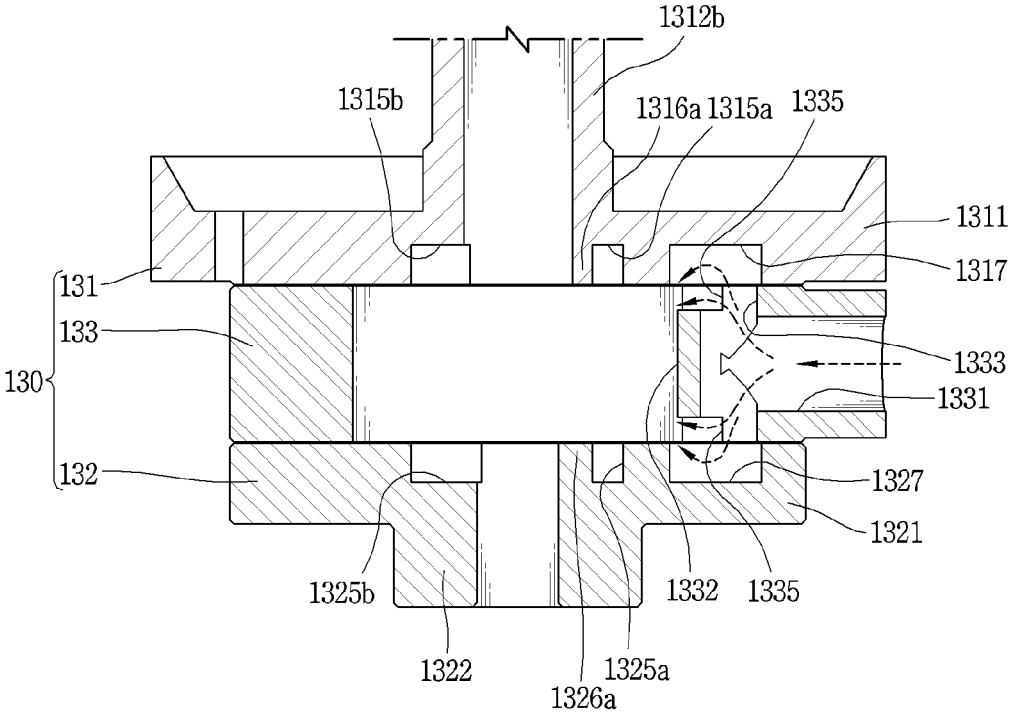
FIG. 11 is a longitudinal cross-sectional view of the cylinder of FIG. 10.

FIG. 10 is a perspective view showing another example of the cylinder of the rotary compressor according to an embodiment. FIG. 11 is a longitudinal cross-sectional view of the cylinder of FIG. 10.

An inlet guide portion (inlet guide) 1335 may be disposed on the upper and lower surfaces of the cylinder 133. The inlet guide portion 1335 may allow refrigerant flowing in the suction passage 1333 to flow into the compression space V, and referring to FIGS. 10 and 11, the inlet guide portion 1335 has a predetermined width and depth, and may be disposed to provide communication between the compression space V and the suction passage 1333.

In addition, the inlet guide portion 1335 may be defined in a shape in which an inner periphery of the cylinder 133 adjacent to the suction passage 1333 and a portion of upper and lower surfaces of the cylinder 133 are cut off. The inlet guide portion 1335 may be formed, for example, by a chamfering process having a predetermined width and depth. As shown in FIG. 10, a central longitudinal axis $CE_1$ of the inlet guide portion 1335 may extend parallel to a central longitudinal axis $CE_2$ of the suction port 1331.

Inflow of refrigerant into the compression space V through the suction passage 1333 may be efficiently carried out by the inlet guide portion 1335 to reduce suction loss of the refrigerant. In addition, even before being accommodated in the suction guide portion 1317, 1327 by the inlet guide portion 1335, refrigerant may more efficiently flow into the compression space V through the inlet guide portion 1335. In particular, a suction area suctioned from the suction passage 1333 into the compression space V may be increased by the inlet guide portion 1335, thereby further reducing surface pressure.

As shown in FIG. 11, a depth of the inlet guide portion 1335 may be defined to a suitable depth so as to be equal to or lower than that of the suction guide portion 1317, 1327. The inlet guide portion 1335 may be disposed to have a suitable depth, thereby preventing a problem in which a contact area with the vanes 1351, 1352, 1353 decreases and a problem in which a surface pressure thereto increases.

Figure 12:
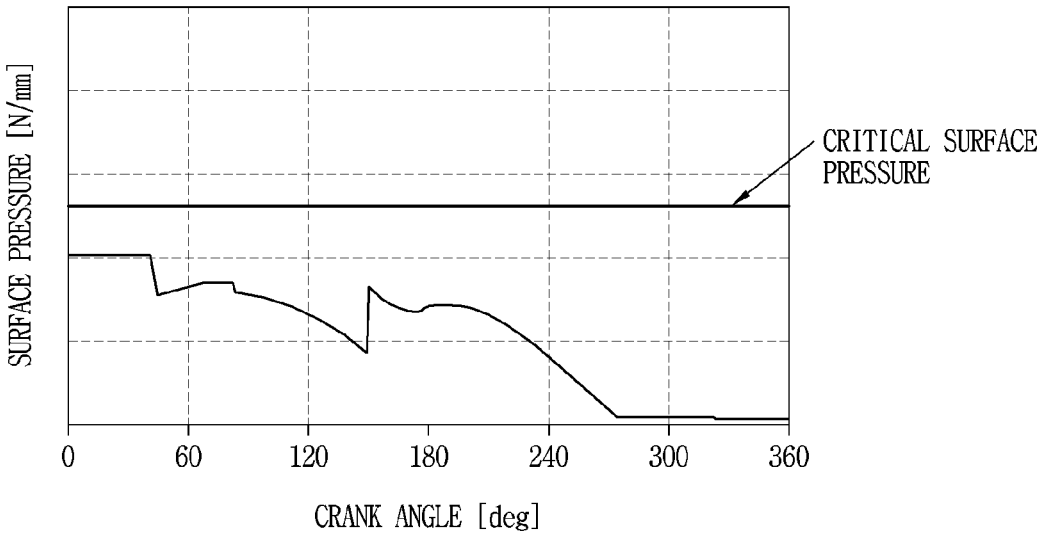
FIG. 12 is a graph showing an efficiency of a surface pressure according to embodiments.

FIG. 12 is a graph showing an efficiency of surface pressure according to embodiments. Referring to FIG. 12, there exists a point exceeding a critical surface pressure of the suction port 1331 between crank angles of 0 and 60 degrees due to an inflow of refrigerant gas through the lateral suction port 1331 in the case of the rotary compressor 100 in the related art, but the critical surface pressure of the suction port 1331 is not exceeded due to a decrease in surface pressure at the suction port 1331 between 0 and 60 degrees in the rotary compressor according to embodiments.

Figure 13:
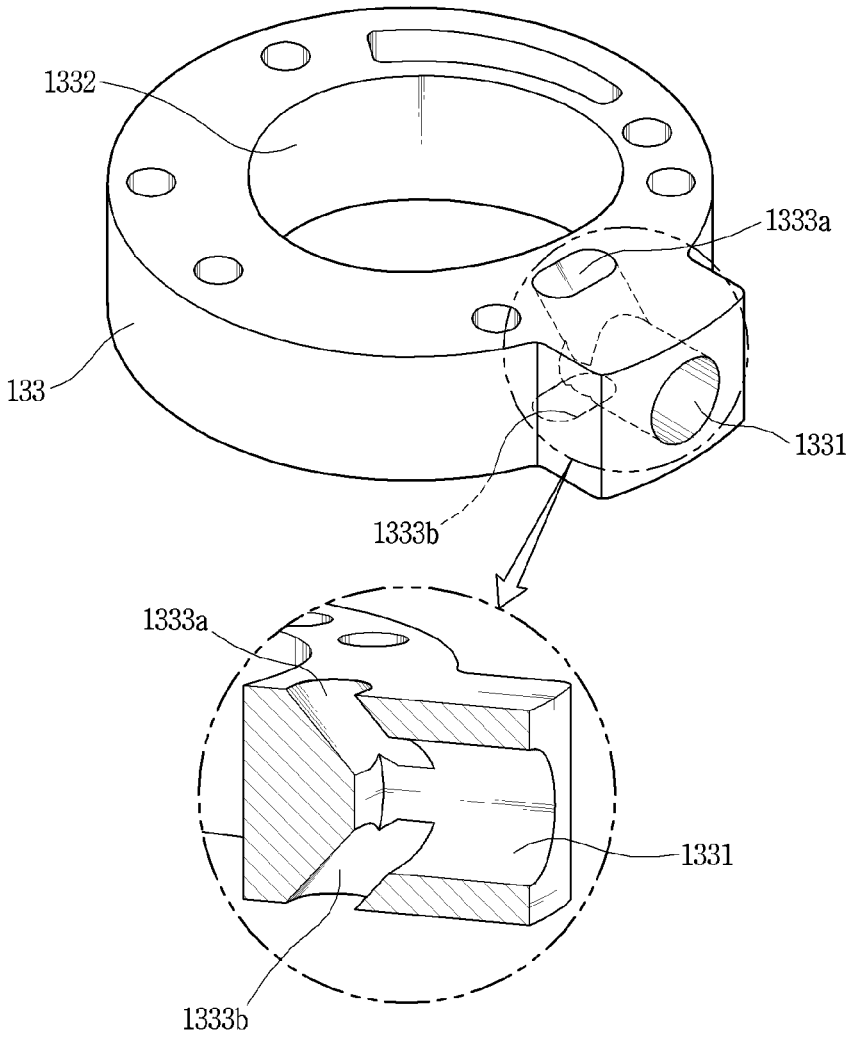
FIG. 13 is a perspective view showing still another example of a cylinder of the rotary compressor according to an embodiment.

FIG. 13 is a perspective view showing still another example of a cylinder of the rotary compressor 100 according to embodiments. FIG. 14 is a longitudinal cross-sectional view of the cylinder of FIG. 13.

Figure 14:
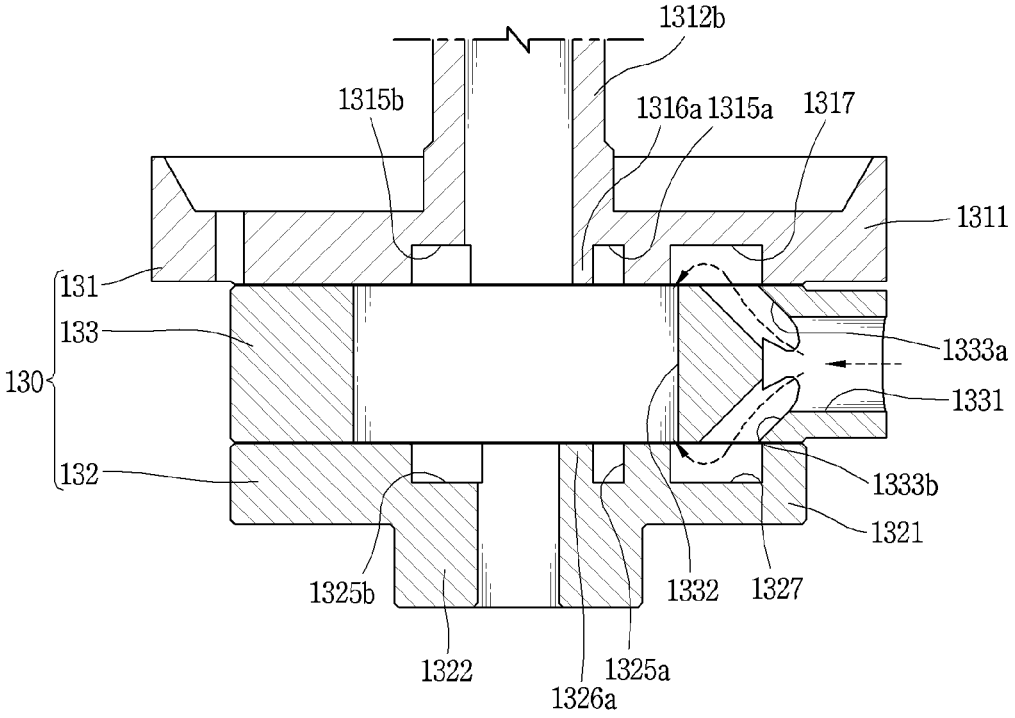
FIG. 14 is a longitudinal cross-sectional view of the cylinder of FIG. 13.

With reference to FIGS. 13 and 14, still another example of cylinder 133 of rotary compressor 100 according to an embodiment in which the suction passage 1333*a*, 1333*b* includes first and second suction passages 1333*a*, 1333*b* will be described.

The suction passage 1333*a*, 1333*b* may include the first and second suction passages 1333*a*, 1333*b*. The first suction passage 1333*a* may be disposed to communicate with the suction port 1331 in a direction crossing a vertical direction, and pass through an upper surface of the cylinder 133. Further, the first suction passage 1333*a* may communicate with the main suction guide portion 1317. The second suction passage 1333*b* may be disposed in a direction crossing the first suction passage 1333*a* to communicate therewith, and pass through a lower surface of the cylinder 133. Furthermore, the second suction passage 1333*b* may communicate with the sub suction guide portion 1327.

In the rotary compressor 100 according to embodiments, refrigerant suctioned through the suction port 1331 may pass through the first and second suction passages 1333*a*, 1333*b*, and the refrigerant that has passed through the first and second suction passages 1333*a*, 1333*b*, respectively, may be guided through the main suction guide portion 1317 and the sub suction guide portion 1327, respectively, to flow into the compression space V, thereby reducing loss in the suction flow path, and constituting an advantageous structure capable of improving suction efficiency of the rotary compressor 100.

Referring to FIGS. 13 and 14, an example is shown in which the suction passage 1333 includes the first and second suction passages 1333*a*, 1333*b*. Further, an example is shown in which the first and second suction passages 1333*a*, 1333*b* are defined with a Y-shaped cross section in FIG. 14 along with the suction port 1331 communicating therewith. Furthermore, referring to FIG. 14, an example is shown in which the first and second suction passages 1333*a*, 1333*b* are respectively disposed in upper-left and lower-left directions from a left or first side end of the suction port 1331, and may be respectively disposed in a diagonal direction of about 45 degrees.

In addition, as the first suction passage 1333*a* communicates with the main suction guide portion 1317, and the second suction passage 1333*b* communicates with the sub suction guide portion 1327, refrigerant suctioned through the suction port 1331 may pass through the first and second suction passages 1333*a*, 1333*b*, and the refrigerant that has passed through the first and second suction passages 1333*a*, 1333*b*, respectively, may be guided through the main suction guide portion 1317 and the sub suction guide portion 1327, respectively, to flow into the compression space V, thereby reducing loss in the suction flow path, and constituting an advantageous structure capable of improving suction efficiency of the rotary compressor 100.

Hereinafter, with reference to FIG. 3 again, structure related to the vane 1351, 1352, 1353 that pressurizes an inner periphery of the cylinder 133 by a back pressure of a back pressure chamber 1343*a*, 1343*b*, 1343*c* will be described. At least one of the main bearing 131 and the sub bearing 132 may be provided with at least one of back pressure pockets 1315*a*, 1315*b*, 1325*a*, 1325*b* concavely disposed to communicate with the compression space V.

The back pressure chamber 1343*a*, 1343*b*, 1343*c* may be disposed at an inner end of the vane slot 1342*a*, 1342*b*, 1342*c*, and the back pressure chamber 1343*a*, 1343*b*, 1343*c* receives a back pressure from the back pressure pocket 1315*a*, 1315*b*, 1325*a*, 1325*b* while communicating with the back pressure pocket 1315*a*, 1315*b*, 1325*a*, 1325*b* to pressurize the vane 1351, 1352, 1353 toward the inner periphery of the cylinder 133.

The back pressure chamber 1343*a*, 1343*b*, 1343*c* may be provided at an inner end of the vane slot 1342*a*, 1342*b*, 1342*c*, and may be understood as a space defined between the rear end of the vane 1351, 1352, 1353 and the inner end of the vane slot 1342*a*, 1342*b*, 1342*c*. The back pressure chambers 1343*a*, 1343*b*, 1343*c* may communicate with first and second main back pressure pockets 1315*a*, 1315*b* and first and second sub back pressure pockets 1325*a*, 1325*b*, which will be described hereinafter, to receive back pressures from the first and second main back pressure pockets 1315*a*, 1315*b* and the first and second sub back pressure pockets 1325*a*, 1325*b* in such a manner that front end surfaces 1351*a*, 1352*a*, 1353*a* of the vanes 1351, 1352, 1353 may be disposed to be in contact with the inner periphery of the cylinder 133 or to be spaced apart from the inner periphery of the cylinder 133 by a predetermined distance.

At least a portion of the back pressure chamber 1343*a*, 1343*b*, 1343*c* may be defined as an arc surface, and a diameter of the arc surface of the back pressure chamber 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well as to prevent a back pressure at rear ends of the vanes 1351, 1352, 1353 from being excessively increased.

In FIG. 3, an example is shown in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is made smaller than a distance between the first and second main back pressure pockets 1315*a*, 1315*b*. For example, when a high back pressure is received from the first main back pressure pocket 1315*a* and the first sub back pressure pocket 1325*a*, the vane 1351, 1352, 1353 may be maximally drawn out such that front end surface 1351*a*, 1352*a*, 1353*a* of the vane 1351, 1352, 1353 comes into contact with an inner periphery of the cylinder 133, and when an intermediate back pressure is received from the second main back pressure pocket 1315*b* and the second sub back pressure pocket 1325*b*, the vane 1351, 1352, 1353 may be drawn out in relatively small amount such that the front end surface 1351*a*, 1352*a*, 1353*a* of the vane 1351, 1352, 1353 is spaced apart from the inner periphery of the cylinder 133 by a predetermined distance.

For example, until the front end surface 1351*a*, 1352*a*, 1353*a* of the vane 1351, 1352, 1353 is adjacent to the suction port 1331 of the cylinder 133 such that high-pressure refrigerant at the front end surface 1351*a*, 1352*a*, 1353*a* of the vane 1351, 1352, 1353 is bypassed to the suction port 1331, the back pressure pocket 1315*a*, 1315*b*, 1325*a*, 1325*b* is in communication with the back pressure chamber 1343*a*, 1343*b*, 1343*c* to allow the front end surface 1351*a*, 1352*a*, 1353*a* of the vane 1351, 1352, 1353 to come into contact with an inner periphery of the cylinder 133, and thus, a predetermined back pressure within the back pressure pocket 1315*a*, 1315*b*, 1325*a*, 1325*b* pressurizes a rear end of the vane 1351, 1352, 1353 through the back pressure chamber 1343*a*, 1343*b*, 1343*c*, and the front end surface 1351*a*, 1352*a*, 1353*a* of the vane 1351, 1352, 1353 comes into contact with the inner periphery of the cylinder 133 while pressurizing the same.

In the embodiments disclosed herein, an example in which the back pressure pockets 1315*a*, 1315*b*, 1325*a*, 1325*b* are provided in both the main bearing 131 and the sub bearing 132 will be described. In addition, one or more back pressure pockets 1315*a*, 1315*b*, 1325*a*, 1325*b* may be disposed in each of the main bearing 131 and the sub bearing 132, and an example in which two back pressure pockets are defined in each of the main bearing 131 and the sub bearing 132 will be described.

However, embodiments are not necessarily limited to this structure, and the back pressure pockets 1315*a*, 1315*b*, 1325*a*, 1325*b* may be provided only in the main bearing 131, and further, may have an example in which one or three of the back pressure pockets 1315*a*, 1315*b*, 1325*a*, 1325*b* is or are defined in each of the main bearing 131 and the sub bearing 132.

The main bearing 131 may include a main plate 1311 coupled to the cylinder 133 to cover an upper side of the cylinder 133. In addition, the sub bearing 132 may include a sub plate 1321 coupled to the cylinder 133 to cover a lower side of the cylinder 133.

The back pressure pockets 1315*a*, 1315*b*, 1325*a*, 1325*b* may include first and second main back pressure pockets 1315*a*, 1315*b* spaced apart from each other at a predetermined distance from a lower surface of the main plate 1311 of the main bearing 131. In addition, the back pressure pockets 1315*a*, 1315*b*, 1325*a*, 1325*b* may further include first and second sub back pressure pockets 1325*a*, 1325*b* spaced apart from each other at a predetermined distance from an upper surface of the sub bearing 132. The detailed configuration of the first and second main back pressure pockets 1315*a*, 1315*b* and the first and second sub back pressure pockets 1325*a*, 1325*b* will be described hereinafter.

On the other hand, it may be understood that the compression unit 130 is configured to include the cylinder 133, the roller 134, the plurality of vanes 1351, 1352, 1353, the main bearing 131, and the sub bearing 132. The main bearing 131 and the sub bearing 132 are provided at both upper and lower sides of the cylinder 133, respectively, to constitute the compression space V together with the cylinder 133, the roller 134 is rotatably provided in the compression space V, the vanes 1351, 1352, 1353 are slidably inserted into the roller 134, the plurality of vanes 1351, 1352, 1353 respectively come into contact with the inner periphery of the cylinder 133, and the compression space V is partitioned into a plurality of compression chambers. Referring to FIGS. 1 to 3, the main bearing 131 may be fixedly provided at the intermediate shell 111 of the casing 110. For example, the main bearing 131 may be inserted into and welded to the intermediate shell 111.

The main bearing 131 may be closely coupled to an upper end of the cylinder 133. Accordingly, the main bearing 131 may define an upper surface of the compression space V, and support an upper surface of the roller 134 in an axial direction, and at the same time support an upper half portion of the rotational shaft 123 in a radial direction.

The main bearing 131 may include main plate portion 1311 and main bush portion 1312. The main plate portion 1311 may be coupled to the cylinder 133 to cover an upper side of the cylinder 133. The main bush portion 1312 may extend from the center of the main plate portion 1311 in an axial direction toward the drive motor 120 to support the upper half portion of the rotational shaft 123.

The main plate portion 1311 may be defined in a disk shape, and an outer peripheral surface of the main plate portion 1311 may be closely fixed to an inner peripheral surface of the intermediate shell 111. At least one discharge port 1313*a*, 1313*b*, 1313*c* may be disposed in the main plate portion 1311, a plurality of discharge valves 1361, 1362, 1363 may be provided at an upper surface of the main plate portion 1311 to open and close each discharge port 1313*a*, 1313*b*, 1313*c*, and a discharge muffler 137 having a discharge space (no reference numeral) may be provided at an upper side of the main plat portion 1311 to accommodate the discharge ports 1313*a*, 1313*b*, 1313*c* and the discharge valves 1361, 1362, 1363. The discharge ports 1313*a*, 1313*b*, 1313*c* will be described hereinafter.

Referring to FIGS. 4 and 7, first main back pressure pocket 1315*a* and second main back pressure pocket 1315*b* may be disposed on a lower surface of the main plate portion 1311 facing an upper surface of the roller 134 between both axial side surfaces of the main plate portion 1311. The first main back pressure pocket 1315*a* and the second main back pressure pocket 1315*b* may be defined in an arc shape and disposed at a predetermined interval along a circumferential direction. Inner peripheral surfaces of the first main back pressure pocket 1315*a* and the second main back pressure pocket 1315*b* may be defined in a circular shape, but outer peripheral surfaces thereof may be defined in an elliptical shape in consideration of the vane slots 1342*a*, 1342*b*, 1342*c* described hereinafter.

Further, referring to FIGS. 5 and 7, an example in which inner peripheral surfaces of both the first and second main back pressure pockets 1315*a* and 1315*b* have a circular shape but outer peripheral surfaces thereof have an elliptical shape is shown; however, embodiments are not necessarily limited to this structure. In addition, for example, the first main back pressure pocket 1315*a* may accommodate high-pressure refrigerant to provide a high back pressure to a rear end of the vane 1351, 1352, 1353, and the second main back pressure pocket 1315*b* may accommodate intermediate-pressure refrigerant to provide an intermediate back pressure to the rear end of the vane 1351, 1352, 1353.

The first main back pressure pocket 1315*a* and the second main back pressure pocket 1315*b* may be defined within an outer diameter range of the roller 134. Accordingly, the first main back pressure pocket 1315*a* and the second main back pressure pocket 1315*b* may be separated from the compression space V.

For example, a back pressure in the first main back pressure pocket 1315*a* may be greater than that in the second main back pressure pocket 1315*b*. That is, the first main back pressure pocket 1315*a* may be provided in a vicinity of the discharge ports 1313*a*, 1313*b*, 1313*c* to provide a discharge back pressure. Further, the second main back pressure pocket 1315*b* may define an intermediate pressure between the suction pressure and the discharge pressure.

In the first main back pressure pocket 1315*a*, oil (refrigerant oil) may pass through a fine passage between a first main bearing protrusion 1316*a* and an upper surface 134*a* of the roller 134, which will be described hereinafter, to flow into the first main back pressure pocket 1315*a*. The second main back pressure pocket 1315*b* may be defined within a range of the compression chamber defining an intermediate pressure in the compression space V. Accordingly, the second main back pressure pocket 1315*b* maintains an intermediate pressure.

The second main back pressure pocket 1315*b* may define an intermediate pressure which is a pressure lower than that of the first main back pressure pocket 1315*a*. In the second main back pressure pocket 1315*b*, oil flowing into the main bearing hole 1312*a* of the main bearing 131 through the first oil through hole 126*a* may flow into the second main back pressure pocket 1315*b*. The second main back pressure pocket 1315*b* may be defined within a range of the compression chamber V2 defining a suction pressure in the compression space V. Accordingly, the second main back pressure pocket 1315*b* maintains the suction pressure.

In addition, the first main bearing protrusion 1316*a* and the second main bearing protrusion 1316*b* may be disposed on inner peripheral sides of the first main back pressure pocket 1315*a* and the second main back pressure pocket 1315*b*, respectively, to extend from the main bearing surface 1312*b* of the main bush portion 1312. Accordingly, the first main back pressure pocket 1315*a* and the second main back pressure pocket 1315*b* may be sealed to the outside, and at the same time, the rotational shaft 123 may be stably supported.

The first main bearing protrusion 1316*a* and the second main bearing protrusion 1316*b* may be disposed at a same height, and an oil communication groove (not shown) or an oil communication hole (not shown) may be disposed on an inner peripheral end surface of the second main bearing protrusion 1316*b*. Alternatively, an inner peripheral height of the second main bearing protrusion 1316*b* may be disposed to be lower than that of the first main bearing protrusion 1316*a*. Accordingly, high-pressure oil (refrigerant oil) flowing into the main bearing surface 1312*b* may flow into the first main back pressure pocket 1315*a*. The first main back pressure pocket 1315*a* defines a higher pressure (discharge pressure) than the second main back pressure pocket 1315*b*.

The main bush portion 1312 may be disposed in a hollow bearing shape, and a first oil groove 1312*c* may be disposed on an inner peripheral surface of the main bearing hole 1312*a* constituting an inner peripheral surface of the main bush portion 1312. The first oil groove 1312*c* may be defined in an oblique or spiral shape between upper and lower ends of the main bush portion 1312 such that the lower end thereof communicates with the first oil through hole 126*a*.

In FIG. 4, an example is shown in which the main bush portion 1312 is defined in an upward direction in a hollow bearing shape on the main plate 1311, and the oil groove 1312*c* is defined in an oblique direction on an inner peripheral surface of the main bearing hole 1312*a* constituting an inner peripheral surface of the main bush portion 1312. Although not shown in the drawings, an oil groove may be defined in a diagonal or spiral shape on an outer peripheral surface of the rotational shaft 123, that is, an outer peripheral surface of the main bearing portion 123*b*.

Referring to FIGS. 1 and 2, the sub bearing 132 may be closely coupled to a lower end of the cylinder 133. Accordingly, the sub bearing 132 defines a lower surface of the compression space V, and supports a lower surface of the roller 134 in an axial direction, and at the same time, supports a lower half portion of the rotational shaft 123 in a radial direction. Referring to FIGS. 2 and 4, the sub bearing 132 may include sub plate portion 1321 and sub bearing portion 1322.

The sub plate portion 1321 may be coupled to the cylinder 133 to cover a lower side of the cylinder 133. The sub bearing portion 1322 may extend from a center of the sub plate portion 1321 in an axial direction toward the lower shell 112 to support the lower half portion of the rotational shaft 123.

The sub plate portion 1321 may be defined in a disk shape similar to that of the main plate portion 1311. An outer peripheral surface of the sub plate portion 1321 may be spaced apart from an inner peripheral surface of the intermediate shell 111.

A first sub back pressure pocket 1325*a* and a second sub back pressure pocket 1325*b* may be disposed on an upper surface of the sub plate portion 1321 facing a lower surface of the roller 134 between both axial side surfaces of the sub plate portion 1321. The first sub back pressure pocket 1325*a* and the second sub back pressure pocket 1325*b* may be disposed to be symmetrical with respect to the first main back pressure pocket 1315*a* and the second main back pressure pocket 1315*b*, respectively, described above around the roller 134.

Further, the first and second sub back pressure pockets 1325*a*, 1325*b* may be defined in a shape corresponding to the first and second main back pressure pockets 1315*a*, 1315*b*, respectively. For example, the first sub back pressure pocket 1325*a* may be disposed to be symmetrical with respect to the first main back pressure pocket 1315*a* with the roller 134 interposed therebetween, and the second sub back pressure pocket 1325*b* to be symmetrical with respect to the second main back pressure pocket 1315*b* with the roller 134 interposed therebetween.

A first sub bearing protrusion 1326*a* may be disposed on an inner peripheral side of the first sub back pressure pocket 1325*a*, and a second sub bearing protrusion 1326*b* may be disposed on an inner peripheral side of the second sub back pressure pocket 1325*b*, respectively. However, in some cases, the first sub back pressure pocket 1325*a* and the second sub back pressure pocket 1325*b* may be disposed to be asymmetrical with respect to the first main back pressure pocket 1315*a* and the second main back pressure pocket 1315*b*, respectively, around the roller 134. For example, the first sub back pressure pocket 1325*a* and the second sub back pressure pocket 1325*b* may be disposed to have different depths from those of the first main back pressure pocket 1315*a* and the second main back pressure pocket 1315*b*.

In addition, an oil supply hole (not shown) may be disposed between the first sub back pressure pocket 1325*a* and the second sub back pressure pocket 1325*b*, more precisely, between the first sub bearing protrusion 1326*a* and the second sub bearing protrusion 1326*b* or at a portion at which the first sub bearing protrusion 1326*a* and the second sub bearing protrusion 1326*b* are connected to each other.

For example, a first end constituting an inlet of the oil supply hole (not shown) may be disposed to be submerged in the oil storage space 110*b*, and a second end constituting an outlet of the oil supply hole may be disposed to be positioned on a rotation path of the back pressure chambers 1343*a*, 1343*b*, 1343*c* on an upper surface of the sub plate portion 1321 facing a lower surface of the roller 134 described hereinafter. Accordingly, during rotation of the roller 134, high-pressure oil stored in the oil storage space 110*b* may be periodically supplied to the back pressure chambers 1343*a*, 1343*b*, 1343*c* through the oil supply hole (not shown) while the back pressure chambers 1343*a*, 1343*b*, 1343*c* periodically communicate with the oil supply hole (not shown), and through this, each of the vanes 1351, 1352, 1353 may be stably supported toward the inner peripheral surface 1332 of the cylinder 133.

The sub bearing portion 1322 may be disposed in a hollow bush shape, and a second oil groove 1322*c* may be disposed on an inner peripheral surface of the sub bearing hole 1322*a* constituting an inner peripheral surface of the sub bearing portion 1322. The second oil groove 1322*c* may be defined in a straight line or an oblique line between upper and lower ends of the sub bearing portion 1322 such that the upper end thereof communicates with the second oil through hole 126*b* of the rotational shaft 123.

Although not shown in the drawings, an oil groove may be defined in a diagonal or spiral shape on an outer peripheral surface of the rotational shaft 123, that is, an outer peripheral surface of a sub bearing portion 123*c*. In addition, although not shown in the drawings, the back pressure pockets 1315*a*, 1315*b*, 1325*a*, 1325*b* may be disposed in only one of the main bearing 131 or the sub bearing 132.

The discharge ports 1313*a*, 1313*b*, 1313*c* may be disposed in the main bearing 131 as described above. However, the discharge ports 1313*a*, 1313*b*, 1313*c* may be disposed in the sub bearing 132 or may be disposed in the main bearing 131 and the sub bearing 132, respectively, and disposed to pass through between inner and outer peripheral surfaces of the cylinder 133. This embodiment will be mainly described with respect to an example in which the discharge ports 1313*a*, 1313*b*, 1313*c* are disposed in the main bearing 131.

Only one discharge port 1313*a*, 1313*b*, 1313*c* may be disposed. However, in the discharge ports 1313*a*, 1313*b*, 1313*c* according to this embodiment, the plurality of the discharge ports 1313*a*, 1313*b*, 1313*c* may be disposed at a predetermined interval along a compression advancing direction (or a rotational direction of the roller 134, a clockwise direction indicated by an arrow on the roller 134 in FIG. 3). Referring to FIGS. 3 and 7, an example is shown in which a total of six discharge ports 1313*a*, 1313*b*, 1313*c* in pairs are disposed to pass through the main bearing 131.

In general, in the vane 1351, 1352, 1353 type rotary compressor 100, as the roller 134 is disposed eccentrically with respect to the compression space V, a proximal point P1 almost in contact between outer peripheral surface 1341 of the roller 134 and inner peripheral surface 1332 of the cylinder 133 is generated, and the discharge port 1313*a*, 1313*b*, 1313*c* is disposed in the vicinity of the proximal point P1. Accordingly, as the compression space V approaches the proximal point P1, a distance between the inner peripheral surface 1332 of the cylinder 133 and the outer peripheral surface 1341 of the roller 134 is greatly decreased, thereby making it difficult to secure an area for the discharge port 1313*a*, 1313*b*, 1313*c*.

As a result, as in this embodiment, the discharge port 1313*a*, 1313*b*, 1313*c* may be divided into a plurality of discharge ports 1313*a*, 1313*b*, 1313*c* to be defined along a rotational direction (or compression advancing direction) of the roller 134. Further, the plurality of discharge ports 1313*a*, 1313*b*, 1313*c* may be respectively defined one by one, or may be defined in pairs as in this embodiment.

For example, referring to FIG. 3, an example is shown in which the discharge ports 1313*a*, 1313*b*, 1313*c* according to this embodiment are arranged in the order of the first discharge port 1313*a*, the second discharge port 1313*b*, and the third discharge port 1313*c* from the discharge ports 1313*a*, 1313*b*, 1313*c* disposed relatively far from a proximal portion 1332*a*. According to the example shown in FIG. 3, the plurality of discharge ports 1313*a*, 1313*b*, 1313*c* may communicate with one compression chamber.

Although not shown in the drawings, a first gap between the first discharge port 1313*a* and the second discharge port 1313*b*, a second gap between the second discharge port

1313*b* and the third discharge port 1313*c*, and a third gap between the third discharge port 1313*c* and the first discharge port 1313*a* may be defined to be the same as one another. The first gap, the second gap, and the third gap may be defined to be substantially the same as a circumferential length of the first compression chamber V1, a circumferential length of the second compression chamber V2, and a circumferential length of the third compression chamber V3, respectively.

In addition, the plurality of discharge ports 1313*a*, 1313*b*, 1313*c* may communicate with one compression chamber, and the plurality of compression chambers do not communicate with one discharge port 1313*a*, 1313*b*, 1313*c*, but the first discharge port 1313*a* may communicate with the first compression chamber V1, the second discharge port 1313*b* with the second compression chamber V2, and the third discharge port 1313*c* with the third compression chamber V3, respectively.

However, unlike this embodiment, when the vane slots 1342*a*, 1342*b*, 1342*c* are defined at unequal intervals, the circumferential length of each compression chamber V1, V2, V3 may be defined to be different, and a plurality of compression ports 1313*a*, 1313*b*, 1313*c* may communicate with one compression chamber or a plurality of compression chambers may communicate with one discharge port 1313*a*, 1313*b*, 1313*c*.

In addition, referring to FIG. 3, a discharge groove (not shown) may be disposed to extend to the discharge port 1313*a*, 1313*b*, 1313*c* according to this exemplary embodiment. The discharge groove may extend in an arc shape along a compression advancing direction (rotational direction of the roller 134). Accordingly, refrigerant which is not discharged from a preceding compression chamber may be guided to the discharge port 1313*a*, 1313*b*, 1313*c* communicating with a subsequent compression chamber through the discharge groove to be discharged together with the refrigerant compressed in the subsequent compression chamber. Through this, residual refrigerant in the compression space V may be minimized to suppress over-compression, thereby improving compressor efficiency.

The discharge groove as described above may be disposed to extend from the final discharge port 1313*a*, 1313*b*, 1313*c* (for example, the third discharge port 1313*c*). In general, in the vane 1351, 1352, 1353 type rotary compressor 100, the compression space V may be partitioned into a suction chamber and a discharge chamber at both sides with the proximal portion (proximal point) 1332*a* interposed therebetween, the discharge port 1313*a*, 1313*b*, 1313*c* is unable to overlap the proximal point P1 positioned in the proximal portion 1332*a* in consideration of sealing between the suction chamber and discharge chamber. Accordingly, between the proximal point P1 and the discharge ports 1313*a*, 1313*b*, 1313*c*, a residual space spaced apart between the inner peripheral surface 1332 of the cylinder 133 and the outer peripheral surface 1341 of the roller 134 is defined along a circumferential direction, refrigerant remains in this residual space without being discharged through the final discharge port 1313*a*, 1313*b*, 1313. The residual refrigerant may increase a pressure of the final compression chamber to cause a decrease in compression efficiency due to over-compression.

However, as in this embodiment, when the discharge groove extends from the final discharge port 1313*a*, 1313*b*, 1313*c* to the residual space, refrigerant remaining in the remaining space may flow backward through the discharge groove to the final discharge port 1313*a*, 1313*b*, 1313*c* to effectively suppress a decrease in compression efficiency due to over-compression in the final compression chamber due to being further discharged.

Although not shown in the drawings, a residual discharge hole may be disposed in a residual space in addition to the discharge groove. The residual discharge hole may be disposed to have a smaller inner diameter compared to the discharge port 1313*a*, 1313*b*, 1313*c*, and unlike the discharge port 1313*a*, 1313*b*, 1313*c*, the residual discharge hole may be always open without being opened or closed by the discharge valve.

Further, the plurality of discharge ports 1313*a*, 1313*b*, 1313*c* may be opened and closed by respective discharge valves 1361, 1362, 1363 described above. Each of the discharge valves 1361, 1362, 1363 may be configured with a cantilevered reed valve having one or a first end constituting a fixed end and the other or a second end constituting a free end. As each of these discharge valves 1361, 1362, 1363 is widely known in the rotary compressor 100 in the related art, detailed description thereof has been omitted.

Referring to FIGS. 1 to 3, the cylinder 133 according to this embodiment may be in close contact with a lower surface of the main bearing 131 and bolt-fastened to the main bearing 131 together with the sub bearing 132. As described above, as the main bearing 131 is fixedly coupled to the casing 110, the cylinder 133 may be fixedly coupled to the casing 110 by the main bearing 131.

The cylinder 133 may be defined in an annular shape having an empty space portion to form the compression space V in the center. The empty space portion may be sealed by the main bearing 131 and the sub bearing 132 to form the above-described compression space V, and the roller 134 may be rotatably coupled to the compression space V.

Referring to FIGS. 1 and 2, the cylinder 133 may be defined such that the suction port 1331 passes through inner and outer peripheral surfaces thereof. However, unlike FIG. 2, the suction port 1331 may be disposed to pass through inner and outer peripheral surfaces of the main bearing 131 or the sub bearing 132.

The suction port 1331 may be disposed at one side in a circumferential direction around the proximal point P1 described hereinafter. The discharge ports 1313*a*, 1313*b*, 1313*c* described above may be disposed in the main bearing 131 at the other side in a circumferential direction opposite to the suction port 1331 around the proximal point P1.

The inner peripheral surface 1332 of the cylinder 133 may be defined in an elliptical shape. The inner peripheral surface 1332 of the cylinder 133 according to this embodiment may be defined in an asymmetric elliptical shape by combining a plurality of ellipses, for example, four ellipses having different major and minor ratios to have two origins.

More specifically, the inner peripheral surface 1332 of the cylinder 133 according to this embodiment may be defined to have a first origin Or, which is a rotational center of the roller 134 (an axial center or an outer diameter center of the cylinder 133), and a second origin O' that is biased toward a distal portion 1332*b* with respect to the first origin Or. The X-Y plane defined around the first origin Or defines third and fourth quadrants, and the X-Y plane defined around the second origin O' defines first and second quadrants. The third quadrant may be defined by the third ellipse, the fourth quadrant by the fourth ellipse, respectively, and the first quadrant may be defined by the first ellipse, and the second quadrant by the second ellipse, respectively.

In addition, referring to FIG. 3, the inner peripheral surface 1332 of the cylinder 133 according to this embodiment may include a proximal portion 1332*a*, a distal portion 1332*b*, and a curved portion 1332*c*. The proximal portion 1332*a* is a portion closest to an outer peripheral surface of the roller 134 (or the rotational center Or of the roller 134), the distal portion 1332*b* is a portion farthest from the outer peripheral surface 1341 of the roller 134, and the curved portion 1332*c* is a portion connecting the proximal portion 1332*a* and the distal portion 1332*b*.

Referring to FIGS. 3 and 4, the roller 134 may be rotatably provided in the compression space V of the cylinder 133, and the plurality of vanes 1351, 1352, 1353 may be inserted at a predetermined interval into the roller 134 along a circumferential direction. Accordingly, compression chambers as many as the number of the plurality of vanes 1351, 1352, 1353 may be partitioned and defined in the compression space V. In this embodiment, it will be mainly described an example in which the plurality of vanes 1351, 1352, 1353 are made up of three and the compression space V are partitioned into three compression chambers.

The roller 134 according to this embodiment has an outer peripheral surface 1341 defined in a circular shape, and the rotational shaft 123 may be a single body or may be post-assembled and combined therewith at the rotational center Or of the roller 134. Accordingly, the rotational center Or of the roller 134 may be coaxially positioned with respect to an axial center (unsigned) of the rotational shaft 123, and the roller 134 rotates concentrically together with the rotational shaft 123.

However, as described above, as the inner peripheral surface 1332 of the cylinder 133 is defined in an asymmetric elliptical shape biased in a specific direction, the rotational center Or of the roller 134 may be eccentrically disposed with respect to an outer diameter center Oc of the cylinder 133. Accordingly, in the roller 134, one side of the outer peripheral surface 1341 is almost in contact with the inner peripheral surface 1332 of the cylinder 133, more precisely, the proximal portion 1332*a* to define the proximal point P1.

The proximal point P1 may be defined in the proximal portion 1332*a* as described above. Accordingly, an imaginary line passing through the proximal point P1 may correspond to a major axis of an elliptical curve defining the inner peripheral surface 1332 of the cylinder 133.

In addition, the roller 134 may have a plurality of vane slots 1342*a*, 1342*b*, 1342*c* disposed to be spaced apart from one another along a circumferential direction on the outer peripheral surface 1341 thereof, and the plurality of vanes 1351, 1352, 1353 described hereinafter may be slidably inserted into and coupled to the vane slots 1342*a*, 1342*b*, 1342*c*, respectively.

Referring to FIG. 4, in the plurality of vane slots 1342*a*, 1342*b*, 1342*c*, first vane slot 1342*a*, second vane slot 1342*b*, and third vane slot 1342*c* are shown along a compression advancing direction (a rotational direction of the roller 134, indicated by a clockwise arrow on the roller 134 in FIG. 3). The first vane slot 1342*a*, the second vane slot 1342*b*, and the third vane slot 1342*c* may be defined to have a same width and depth as one another at equal or unequal intervals along a circumferential direction, and an example is shown in which they are disposed to be spaced apart at equal intervals.

For example, the plurality of vane slots 1342*a*, 1342*b*, 1342*c* may be respectively disposed to be inclined by a predetermined angle with respect to a radial direction so as to sufficiently secure the lengths of the vanes 1351, 1352, 1353. Accordingly, when the inner peripheral surface 1332 of the cylinder 133 is defined in an asymmetric elliptical shape, even though a distance from the outer peripheral surface 1341 of the roller 134 to the inner peripheral surface 1332 of the cylinder 133 increases, the vanes 1351, 1352, 1353 may be suppressed from being released from the vane slots 1342*a*, 1342*b*, 1342*c*, thereby increasing a degree of freedom in designing the inner peripheral surface 1332 of the cylinder 133.

Allowing a direction in which the vane slot 1342*a*, 1342*b*, 1342*c* is inclined to be an opposite direction to a rotational direction of the roller 134, that is, allowing the front end surface 1351*a*, 1352*a*, 1353*a* of each vane 1351, 1352, 1353 in contact with the inner peripheral surface 1332 of the cylinder 133 to be inclined toward a rotational direction of the roller 134 may be advantageous because compression start angle may be pulled toward the rotational direction of the roller 134 to quickly start compression.

The back pressure chambers 1343*a*, 1343*b*, 1343*c* may be disposed to communicate with one another at inner ends of the vane slots 1342*a*, 1342*b*, 1342*c*. The back pressure chamber 1343*a*, 1343*b*, 1343*c* is a space in which refrigerant (oil) at a discharge pressure or intermediate pressure is accommodated toward a rear side of each vane 1351, 1352, 1353, that is, the rear end portion 1351*b*, 1352*b*, 1353*b* of the vane 1351, 1352, 1353, and the each vane 1351, 1352, 1353 may be pressurized toward an inner peripheral surface of the cylinder 133 by a pressure of the refrigerant (or oil) filled in the back pressure chamber 1343*a*, 1343*b*, 1343*c*. For convenience, hereinafter, it will be described that a direction toward the cylinder 133 with respect to a movement direction of the vane 1351, 1352, 1353 is defined as a front side, and an opposite side thereto as a rear side.

The back pressure chamber 1343*a*, 1343*b*, 1343*c* may be disposed to be sealed by the main bearing 131 and the sub bearing 132 at upper and lower ends thereof, respectively. The back pressure chambers 1343*a*, 1343*b*, 1343*c* may communicate independently with respect to each of the back pressure pockets 1315*a*, 1315*b*, 1325*a*, 1325, and may be disposed to communicate with one another by the back pressure pockets 1315*a*, 1315*b*, 1325*a*, 1325*b*.

In addition, as described above, at least part or portion of the back pressure chambers 1343*a*, 1343*b*, 1343*c* may be defined as an arc surface, and a diameter of the arc surface of the back pressure chambers 1343*a*, 1343*b*, 1343*c* may be smaller than a distance between the first and second main back pressure pockets 1315*a*, 1315*b*. Due to this, when communicating with the first main back pressure pocket 1315*a* at high pressure by a discharge back pressure to receive the discharge back pressure while at the same time communicating with the second main back pressure pocket 1315*b*, an intermediate pressure of the second main back pressure pocket 1315*b* may be received as well to prevent the back pressure at rear ends of the vanes 1351, 1352, 1353 from being excessively increased.

In FIG. 3, an example is shown in which the back pressure chamber 1343*a*, 1343*b*, 1343*c* is connected to the vane slot 1342*a*, 1342*b*, 1342*c* while having an arc surface, and a diameter of the arc surface of the back pressure chamber 1343*a*, 1343*b*, 1343*c* is made smaller than a distance between the first and second main back pressure pockets 1315*a*, 1315*b*. Referring to FIGS. 3 and 4, the plurality of vanes 1351, 1352, 1353 according to this embodiment may be slidably inserted into the vane slots 1342*a*, 1342*b*, 1342*c*, respectively. Accordingly, the plurality of vanes 1351, 1352, 1353 may be defined to have substantially a same shape as the vane slots 1342*a*, 1342*b*, 1342*c*, respectively.

For example, the plurality of vanes 1351, 1352, 1353 may be defined as first vane 1351, second vane 1352, and third vane 1353 along a rotational direction of the roller 134, and the first vane 1351 may be inserted into the first vane slot

1342*a*, the second vane 1352 into the second vane slot 1342*b*, and the third vane 1353 into the third vane slot 1342*c*, respectively, and such a configuration is shown in FIGS. 3 and 4. The plurality of vanes 1351, 1352, and 1353 may all have a same shape. More specifically, each of the plurality of vanes 1351, 1352, 1353 may be defined as a substantially rectangular parallelepiped, the front end surface 1351*a*, 1352*a*, 1353*a* in contact with the inner peripheral surface 1332 of the cylinder 133 may be defined as a curved surface, and the rear end surface 1351*b*, 1352*b*, 1353*b* facing the respective back pressure chamber 1343*a*, 1343*b*, 1343*c* may be defined as a straight surface.

FIG. 3 shows an example in which the front end surface 1351*a* of the first vane 1351 starts to come into contact with the cylinder 133 at a side of the suction port 1331, wherein chattering does not occur due to high-pressure back pressure being provided at an rear end of the first vane 1351, the first vane 1351 comes into contact with the inner periphery of the cylinder 133, and high-pressure refrigerant between the front end surfaces 1351*a*, 1352*a*, 1353*a* of the first vane 1351 and the inner circumference of the cylinder 133 is bypassed to the suction port 1331 while the front end surface 1351*a* of the first vane 1351 passes the suction port 1331. At this time, the front end surface 1351*a* of the first vane 1351 comes into contact with the inner periphery of the cylinder 133 while not being pushed back by a high-pressure back pressure in the back pressure pockets 1315*a*, 1315*b*, 1325*a*, 1325*b* communicating with the first main back pressure pocket 1315*a* and the first sub back pressure pocket 1325*a*.

Accordingly, in the rotary compressor 100 according to embodiments disclosed herein, at least one back pressure pocket 1315*a*, 1315*b*, 1325*a*, 1325*b*, which is concavely disposed to communicate with the compression space V, is provided in at least one of the main bearing 131 or the sub bearing 132, the back pressure chamber 1343*a*, 1343*b*, 1343*c* in which a rear end of the vane 1351, 1352, 1353 is accommodated to receive a back pressure from the back pressure pocket 1315*a*, 1315*b*, 1325*a*, 1325*b* while communicating with the back pressure pocket 1315*a*, 1315*b*, 1325*a*, 1325*b* so as to pressurize the vane 1351, 1352, 1353 toward the inner periphery of the cylinder 133 is disposed at an inner end of the vane slot 1342*a*, 1342*b*, 1342*c*, and the back pressure pocket 1315*a*, 1315*b*, 1325*a*, 1325*b* communicates with the back pressure chamber 1343*a*, 1343*b*, 1343*c* until high-pressure refrigerant is bypassed to the suction port 1331 such that the front end surface 1351*a*, 1352*a*, 1353*a* of the vane 1351, 1352, 1353 comes into contact with the inner periphery of the cylinder 133. Due to this, high-pressure refrigerant accumulated between the front end of the vane 1351, 1352, 1353 and the inner periphery of the cylinder 133 may be bypassed to the suction port 1331 on a side surface of the cylinder 133, and a discharge back pressure may be maintained not to allow the vane 1351, 1352, 1353 to be pushed back until the high-pressure refrigerant is bypassed to the suction port 1331 on the side surface of the cylinder 133.

Operation of the rotary compressor 100 according to embodiments disclosed herein will be described hereinafter.

In the rotary compressor 100, when power is applied to the drive motor 120, the rotor 122 of the drive motor 120 and the rotational shaft 123 coupled to the rotor 122 rotate, and the roller 134 coupled to or integrally formed with the rotational shaft 123 rotates together with the rotational shaft 123. Then, the plurality of vanes 1351, 1352, 1353 are drawn out from the respective vane slots 1342*a*, 1342*b*, 1342*c* by a centrifugal force generated by the rotation of the roller 134 and back pressure of the back pressure chamber 1343*a*, 1343*b*, 1343*c* supporting the rear end surface 1351*b*, 1352*b*, 1353*b* of the vane 1351, 1352, 1353 to come into contact with the inner peripheral surface 1332 of the cylinder 133.

Then, the compression space V of the cylinder 133 is partitioned into compression chambers V1, V2, V3 as many as the number of the plurality of vanes 1351, 1352, 1353 by the plurality of vanes 1351, 1352, 1353, a volume of the respective compression chamber V1, V2, V3 is varied by a shape of the inner peripheral surface 1332 of the cylinder 133 and an eccentricity of the roller 134, and refrigerant suctioned into the respective compression chamber V1, V2, V3 is compressed and discharged into an inner space of the casing 110 while moving along the roller 134 and the vane 1351, 1352, 1353. In particular, the refrigerant that has flowed into the suction port 1331 of the cylinder 133 passes through the suction passage 1333 and flows into the compression space V through the suction guide portions 1317, 1327. As described above, according to embodiments disclosed herein, the suction refrigerant passage may move from a lateral direction of the cylinder 133 toward the main bearing 131 and the sub bearing 132 by a predetermined distance, and flow into the compression space V in a vertical direction, thereby reducing a vane contact force and a surface pressure, improving reliability, and overcoming suction loss.

Of course, depending on the shape of the cylinder 133, the refrigerant that has flowed into the suction port 1331 of the cylinder 133 may pass through the first and second suction passages 1333*a*, 1333*b* and flow into the compression space V through the suction guide portions 1317, 1327 disposed in at least one of the main bearing 131 or the sub bearing 132. Alternatively, it has also been described above that when the inlet guide portions 1335 are disposed on the upper and lower surfaces of the cylinder 133, the refrigerant that has flowed into the suction port 1331 of the cylinder 133 passes through the suction passage 1333 to flow into the compression space V through the inlet guide portion 1335.

With this structure, in the rotary compressor 100 according to embodiments disclosed herein, as a structure of the existing suction port 1331 in a simple transverse direction may be configured with the suction passage 1333 and the suction guide portions 1317, 1327 in a longitudinal or oblique direction, a direction of the suction refrigerant flow path may be partially changed to a direction of the main bearing 131 and the sub bearing 132 to decrease a vane contact force and reduce a surface pressure, thereby improving reliability and overcoming suction loss.

Further, in the rotary compressor 100 according to embodiments disclosed herein, the inlet guide portions 1335 may be disposed on the upper and lower surfaces of the cylinder 133 to allow refrigerant to more efficiently flow into the compression space V through the suction passage 1333, thereby reducing the suction loss of the refrigerant. In addition, even before being accommodated in the suction guide portion 1317, 1327, refrigerant may more efficiently flow into the compression space through the inlet guide portion 1335. In particular, a suction area suctioned from the suction passage 1333 into the compression space V may be increased by the inlet guide portion 1335, thereby further reducing surface pressure.

Furthermore, in the rotary compressor 100 according to embodiments disclosed herein, refrigerant suctioned through the suction port 1331 may pass through the first and second suction passages 1333*a*, 1333*b*, and the refrigerant that has passed through the first and second suction passages 1333*a*, 1333*b*, respectively, may be guided through the main suction guide portion 1317 and the sub suction guide portion 1327, respectively, to flow into the compression space V, thereby reducing a loss of the suction flow path, and constituting an advantageous structure capable of improving a suction efficiency of the rotary compressor 100.

In the rotary compressor according to embodiments disclosed herein, refrigerant may pass through the suction port and flow into the compression space in the suction passage to reduce a surface pressure of the suction section by, thereby improving reliability and overcoming suction loss. In addition, in the rotary compressor according to embodiments disclosed herein, a suction guide portion may be disposed in a main bearing and a sub bearing to accommodate and provide refrigerant that has passed through a suction passage to the compression space, thereby reducing a wear phenomenon due to a decrease in surface pressure at a portion of the suction port of the cylinder.

Further, in the rotary compressor according to embodiments disclosed herein, it may be possible to overcome mechanical loss of the compressor itself in an efficient condition by the configuration of the suction passage, and the suction guide portion, for example. Furthermore, in the rotary compressor according to embodiments disclosed herein, as a structure of the existing suction port in a simple transverse direction is configured with a suction passage and a suction guide portion in a longitudinal or oblique direction, a direction of the suction refrigerant flow path may be partially changed to a direction of the main bearing and the sub bearing to decrease a vane contact force and reduce a surface pressure, thereby improving reliability and overcoming suction loss.

Also, in the rotary compressor according to embodiments disclosed herein, inlet guide portions may be disposed on upper and lower surfaces of the cylinder to allow refrigerant to more efficiently flow into the compression space through the suction passage, and reduce suction loss of the refrigerant. Further, the refrigerant may more efficiently flow into the compression space through the inlet guide portions, even before being accommodated in the suction guide portions. In particular, a suction area suctioned from the suction passage to the compression space may be increased by the inlet guide portions, thereby further reducing surface pressure.

In addition, in the rotary compressor according to embodiments disclosed herein, refrigerant suctioned through the suction port may pass through the first and second suction passages, and refrigerant that has passed through the first and second suction passages, respectively, flow into the compression space by being guided through the main suction guide portion and the sub suction guide portion, respectively, thereby constituting an advantageous structure capable of reducing suction passage loss, and improving suction efficiency of the rotary compressor.

Embodiments disclosed herein provide a rotary compressor having structure that reduces a surface pressure of a suction section to improve reliability and overcome suction loss. In particular, embodiments disclosed herein provide a rotary compressor having structure capable of reducing surface pressure applied to a vane through a change of a cylinder suction structure in which refrigerant gas is suctioned in a rotary compressor for automobiles or air conditioning.

Embodiments disclosed herein provide a rotary compressor having structure capable of suctioning refrigerant gas in a vertical direction to reduce a surface pressure applied to a vane so as to expect reliability improvement in a rotary compressor having a cylinder suction structure. Embodiments disclosed herein further provide structure that reduces a surface pressure of a suction section to improve reliability and overcome suction loss in a vane-type compressor for vehicles and air conditioning.

Embodiments disclosed herein also provide structure that reduces wear of a suction port due to a decrease in surface pressure in the vicinity of the suction port through a change of a cylinder suction structure in which refrigerant gas is suctioned in a rotary compressor for automobiles or air conditioning. Embodiments disclosed herein additionally provide structure capable of allowing refrigerant to flow more efficiently into a compression space through a suction passage, and reducing suction loss of the refrigerant in this process. Embodiments disclosed herein provide structure that overcomes mechanical loss in an efficiency condition through a change of a cylinder suction structure in which refrigerant gas is suctioned in a rotary compressor for automobiles or air conditioning.

Embodiments disclosed herein provide a rotary compressor that may include a cylinder having an inner peripheral surface formed in an annular shape to define a compression space; a roller rotatably provided in the compression space of the cylinder, and provided with a plurality of vane slots providing a back pressure at one side thereinside at a predetermined interval along an outer peripheral surface; and a plurality of vanes slidably inserted into the vane slots to rotate together with the roller, front end surfaces of which come into contact with an inner periphery of the cylinder by the back pressure to partition the compression space into a plurality of compression chambers. The cylinder may be provided with a suction passage for refrigerant, the suction passage including a suction port disposed to communicate with the compression space to suction and provide the refrigerant in a lateral direction, and a suction passage disposed in a direction crossing the suction port to communicate between the compression space and the suction port, and the refrigerant is allowed to pass through the suction port and the suction passage to flow into the compression space. With this structure, refrigerant may pass through the suction port and flow into the compression space in the suction passage to reduce a surface pressure of the suction section, thereby improving reliability and overcoming suction loss.

Further, the rotary compressor according to embodiments disclosed herein may further include a main bearing and a sub bearing provided at both ends of the cylinder, respectively, and disposed to be spaced apart from each other to define both surfaces of the compression space, respectively. A suction guide portion concavely defined to communicate between the suction passage and the compression space, and configured to accommodate and provide refrigerant that has passed through the suction passage to the compression space may be disposed in at least one of the main bearing or the sub bearing. Due to this, refrigerant passing through the suction passage may be accommodated and provided to the compression space, thereby reducing wear caused by a decrease in surface pressure at the suction port of the cylinder.

The main bearing may be provided at an upper end of the cylinder to define an upper surface of the compression space. The suction guide portion may include a main suction guide portion concavely defined to communicate between the suction passage and the compression space in the main bearing, and configured to accommodate and provide refrigerant that has passed through the suction passage to the compression space so as to flow in an upward direction.

Further, the sub bearing may be provided at a lower end of the cylinder to define a lower surface of the compression space. The suction guide portion further includes a sub suction guide portion concavely defined to communicate between the suction passage and the compression space in the sub bearing, and configured to accommodate and provide refrigerant that has passed through the suction passage to the compression space so as to flow in a downward direction. Due to this, as structure of the existing suction port in a simple transverse direction may be configured with a suction passage, a main suction guide portion and a sub suction guide portion in a longitudinal or oblique direction, a direction of a suction refrigerant flow path may be partially changed to a direction of the main bearing and the sub bearing to decrease a vane contact force and reduce a surface pressure, thereby improving reliability and overcoming suction loss.

According to another embodiment, at least one of the main suction guide portion or the sub suction guide portion may be defined in an asymmetric structure having one or a first side disposed to face a proximal point and the other or a second side disposed at an opposite side to the one side, the one side being longer than the other side. The suction passage may be disposed to pass through upper and lower surfaces of the cylinder in parallel with a vertical direction. Further, the suction passage may have an elliptical cross section.

An inlet guide portion having a predetermined width and depth to allow refrigerant flowing in the suction passage to flow into the compression space may be disposed on the upper and lower surfaces of the cylinder to communicate between the compression space and the suction passage. The suction guide portion may have a predetermined depth, and a depth of the inlet guide portion may be less than or equal to that of the suction guide portion. The inlet guide portion may be defined in a shape in which an inner periphery of the cylinder adjacent to the suction passage and a portion of the upper and lower surfaces of the cylinder are cut off.

The suction passage may include a first suction passage disposed in a direction crossing a vertical direction, and configured to communicate with the suction port to pass through an upper surface of the cylinder, and a second suction passage disposed in a direction crossing the first suction passage to communicate therewith, and configured to pass through a lower surface of the cylinder.

Embodiments disclosed herein provide a rotary compressor that may include a casing; a drive motor provided inside of the casing to generate rotational power; a cylinder having an inner peripheral surface formed in an annular shape to define a compression space; a roller rotatably provided in the compression space of the cylinder, and provided with a plurality of vane slots providing a back pressure at one side thereinside at a predetermined interval along an outer peripheral surface; a plurality of vanes slidably inserted into the vane slots to rotate together with the roller, front end surfaces of which come into contact with an inner periphery of the cylinder by the back pressure to partition the compression space into a plurality of compression chambers; and a main bearing and a sub bearing provided at both ends of the cylinder, respectively and disposed to be spaced apart from each other to define both surfaces of the compression space, respectively. The cylinder may be provided with a suction passage for refrigerant, the suction passage including a suction port disposed to communicate with the compression space to suction and provide the refrigerant in a lateral direction, and a suction passage disposed in a direction crossing the suction port to communicate between the compression space and the suction port, and the refrigerant is allowed to pass through the suction port and the suction passage to flow into the compression space. With this structure, as a structure of the existing suction port in a simple transverse direction may be configured with a suction passage and a suction guide portion in a longitudinal or oblique direction, a direction of the suction refrigerant flow path may be partially changed to a direction of the main bearing and the sub bearing to decrease a vane contact force and reduce a surface pressure, thereby improving reliability and overcoming suction loss.

The drive motor may include a stator fixedly provided on an inner periphery of the casing; a rotor rotatably inserted into the stator; and a rotational shaft coupled to an inside of the rotor to rotate together with the rotor, and connected to the roller to transmit a rotational force allowing the roller to rotate.

According to an embodiment, a suction guide portion concavely defined to communicate between the suction passage and the compression space, and configured to accommodate and provide refrigerant that has passed through the suction passage to the compression space may be disposed in at least one of the main bearing or the sub bearing. The main bearing may be provided at an upper end of the cylinder to define an upper surface of the compression space, and the suction guide portion may include a main suction guide portion concavely defined to communicate between the suction passage and the compression space in the main bearing, and configured to accommodate and provide refrigerant that has passed through the suction passage to the compression space so as to flow in an upward direction. Further, the sub bearing may be provided at a lower end of the cylinder to define a lower surface of the compression space, and the suction guide portion may further include a sub suction guide portion concavely defined to communicate between the suction passage and the compression space in the sub bearing, and configured to accommodate and provide refrigerant that has passed through the suction passage to the compression space so as to flow in a downward direction.

In the rotary compressor according to embodiments disclosed herein, it may be possible to overcome mechanical loss of the compressor itself in an efficient condition by the configuration of the suction passage, and the main and sub suction guide portions, for example. The suction passage may be disposed to pass through upper and lower surfaces of the cylinder in parallel with a vertical direction. Further, the suction passage may have an elliptical cross section.

An inlet guide portion having a predetermined width and depth to allow refrigerant flowing in the suction passage to flow into the compression space may be disposed on the upper and lower surfaces of the cylinder to communicate between the compression space and the suction passage. For example, the inlet guide portion may be defined in a shape in which an inner periphery of the cylinder adjacent to the suction passage and a portion of the upper and lower surfaces of the cylinder are cut off. In this way, inlet guide portions may be disposed on upper and lower surfaces of the cylinder to allow refrigerant to more efficiently flow into the compression space through the suction passage, and reduce a suction loss of the refrigerant. Further, the refrigerant may more efficiently flow into the compression space through the inlet guide portions, even before being accommodated in the suction guide portions. In particular, a suction area suctioned from the suction passage to the compression space may be increased by the inlet guide portions, thereby further reducing surface pressure.

According to another embodiment, the suction passage may include a first suction passage disposed in a direction crossing a vertical direction, and configured to communicate with the suction port to pass through an upper surface of the cylinder, and a second suction passage disposed in a direction crossing the first suction passage to communicate therewith, and configured to pass through a lower surface of the cylinder.

It is obvious to those skilled in the art that embodiments may be embodied in other specific forms without departing from the concept and essential characteristics thereof. The above detailed description is therefore to be construed in all aspects as illustrative and not restrictive. The scope should be determined by reasonable interpretation of the appended claims and all changes that come within the equivalent scope of the invention are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane rotary compressor, comprising:

a cylinder having an inner peripheral surface formed in an annular shape to define a compression space;

a roller rotatably disposed in the compression space of the cylinder, and including a plurality of vane slots at a predetermined interval along an outer peripheral surface, each providing a back pressure at one side thereof;

a main bearing and a sub bearing provided at both ends of the cylinder, respectively, and spaced apart from each other to define surfaces of the compression space, respectively; and a plurality of vanes slidably inserted into the plurality of vane slots to rotate together with the roller, front end surfaces of which come into contact with the inner peripheral surface of the cylinder due to the back pressure to partition the compression space into a plurality of compression chambers, wherein the cylinder is provided with a suction flow path for refrigerant, the suction flow path comprising a suction port that communicates with the compression space to suction the refrigerant in a lateral direction, and a suction passage disposed in a direction that crosses the suction port to provide communication between the compression space and the suction port, wherein the refrigerant passes through the suction port and the suction passage to flow into the compression space, wherein a suction guide, which is concavely defined to provide communication between the suction passage and the compression space and configured to accommodate refrigerant that has passed through the suction passage, is provided in at least one of the main bearing or the sub bearing, wherein the suction guide has a first side disposed adjacent to an inner circumference of the cylinder adjacent a proximal point, the proximal point being a point at which an outer peripheral surface of the roller and the inner circumference of the cylinder make contact and a second side disposed opposite to the first side and configured to communicate with at least a portion of the suction passage, wherein the first side and the second side are each formed as a curved surface, wherein a radius of the second side is larger than a radius of the first side, and wherein the suction guide is asymmetrical with respect to a radial direction of the cylinder.

2. The vane rotary compressor of claim 1, wherein the main bearing is provided at an upper end of the cylinder to define an upper surface of the compression space, and wherein the suction guide comprises a main suction guide concavely defined to provide communication between the suction passage and the compression space in the main bearing, and configured to accommodate refrigerant that has passed through the suction passage so as to flow in an upward direction.

3. The vane rotary compressor of claim 2, wherein the sub bearing is provided at a lower end of the cylinder to define a lower surface of the compression space, and wherein the suction guide further comprises a sub suction guide concavely defined to provide communication between the suction passage and the compression space in the sub bearing, and configured to accommodate refrigerant that has passed through the suction passage so as to flow in a downward direction.

4. The vane rotary compressor of claim 1, wherein the suction passage passes through upper and lower surfaces of the cylinder in parallel with a vertical direction.

5. The vane rotary compressor of claim 4, wherein the suction passage has an elliptical cross section.

6. The vane rotary compressor of claim 4, wherein an inlet guide having a predetermined width and depth to allow refrigerant flowing in the suction passage to flow into the compression space is disposed on the upper and lower surfaces of the cylinder to provide communication between the compression space and the suction passage.

7. The vane rotary compressor of claim 6, wherein the suction guide has a predetermined depth, and wherein the predetermined depth of the inlet guide is less than or equal to the predetermined depth of the suction guide.

8. The vane rotary compressor of claim 6, wherein the inlet guide is defined by an inner periphery of the cylinder adjacent to the suction passage and a portion of the upper and lower surfaces of the cylinder which are cut off.

9. The vane rotary compressor of claim 1, wherein the suction passage comprises:

a first suction passage that extends in a direction that crosses a vertical direction, and configured to communicate with the suction port to pass through an upper surface of the cylinder; and a second suction passage that extends in a direction that crosses the first suction passage to communicate therewith, and configured to pass through a lower surface of the cylinder.

10. A vane rotary compressor, comprising:

a casing;

a drive motor provided inside of the casing to generate a rotational power;

a cylinder having an inner peripheral surface formed in an annular shape to define a compression space;

a roller rotatably provided in the compression space of the cylinder, and having a plurality of vane slots at a predetermined interval along an outer peripheral surface, each providing a back pressure at one side thereof;

a plurality of vanes slidably inserted into the plurality of vane slots to rotate together with the roller, front end surfaces of which come into contact with the inner peripheral surface of the cylinder due to the back pressure to partition the compression space into a plurality of compression chambers; and a main bearing and a sub bearing provided at both ends of the cylinder, respectively, and spaced apart from each other to define surfaces of the compression space, respectively, wherein the cylinder is provided with a suction flow path for refrigerant, the suction flow path comprising a suction port disposed to communicate with the compression space to suction the refrigerant in a lateral direction, and a suction passage disposed in a direction that crosses the suction port to provide communication between the compression space and the suction port, wherein the refrigerant passes through the suction port and the suction passage to flow into the compression space, wherein an inlet guide is provided on at least one of two surfaces connected to an inner circumference of the cylinder, wherein the inlet guide is formed by the at least one of the two surfaces connected to the inner circumference of the cylinder being cut off so as to be concave in a direction that crosses the suction port to allow refrigerant flowing in the suction passage to flow into the compression space, and wherein a central longitudinal axis of the inlet guide extends parallel to a central longitudinal axis of the suction port.

11. The vane rotary compressor of claim 10, wherein the drive motor comprises:

a stator fixedly provided on an inner periphery of the casing;

a rotor rotatably inserted into the stator; and a rotational shaft coupled to an inside of the rotor to rotate together with the rotor, and connected to the roller to transmit a rotational force to rotate the roller.

12. The vane rotary compressor of claim 10, wherein a suction guide concavely defined to provide communication between the suction passage and the compression space, and configured to accommodate refrigerant that has passed through the suction passage is provided in at least one of the main bearing or the sub bearing.

13. The vane rotary compressor of claim 12, wherein the main bearing is provided at an upper end of the cylinder to define an upper surface of the compression space, and wherein the suction guide comprises a main suction guide concavely defined to provide communication between the suction passage and the compression space in the main bearing, and configured to accommodate refrigerant that has passed through the suction passage so as to flow in an upward direction.

14. The vane rotary compressor of claim 13, wherein the sub bearing is provided at a lower end of the cylinder to define a lower surface of the compression space, and wherein the suction guide further comprises a sub suction guide concavely defined to provide communication between the suction passage and the compression space in the sub bearing, and configured to accommodate refrigerant that has passed through the suction passage so as to flow in a downward direction.

15. The vane rotary compressor of claim 10, wherein the suction passage passes through upper and lower surfaces of the cylinder in parallel with a vertical direction.

16. The vane rotary compressor of claim 15, wherein the inlet guide has a predetermined width and depth, and wherein the inlet guide is disposed on the upper and lower surfaces of the cylinder to provide communication between the compression space and the suction passage.

17. The vane rotary compressor of claim 16, wherein the inlet guide is defined by an inner periphery of the cylinder adjacent to the suction passage and a portion of the upper and lower surfaces of the cylinder.

18. The vane rotary compressor of claim 10, wherein the suction passage comprises:

a first suction passage disposed in a direction that crosses a vertical direction, and configured to communicate with the suction port to pass through an upper surface of the cylinder; and a second suction passage disposed in a direction that crosses the first suction passage to communicate therewith, and configured to pass through a lower surface of the cylinder.

19. A vane rotary compressor, comprising:

a cylinder having an inner peripheral surface defining a compression space;

a roller rotatably disposed in the compression space of the cylinder, and including a plurality of vane slots at a predetermined interval along an outer peripheral surface, each providing a back pressure at one side thereof;

a main bearing and a sub bearing provided at both ends of the cylinder, respectively, and spaced apart from each other to define surfaces of the compression space, respectively; and a plurality of vanes slidably inserted into the plurality of vane slots to rotate together with the roller, front end surfaces of which come into contact with the inner peripheral surface of the cylinder due to the back pressure to partition the compression space into a plurality of compression chambers, wherein the cylinder is provided with a suction flow path for refrigerant, the suction flow path comprising a suction port that communicates with the compression space to suction the refrigerant in a lateral direction, and a suction passage that provides communication between the compression space and the suction port, wherein the refrigerant passes through the suction port and the suction passage to flow into the compression space, wherein a suction guide, which is concavely defined to provide communication between the suction passage and the compression space and configured to accommodate refrigerant that has passed through the suction passage, is provided in at least one of the main bearing or the sub bearing, wherein the suction guide has a first side disposed adjacent to an inner circumference of the cylinder and disposed to face a proximal point, the proximal point being a point at which an outer peripheral surface of the roller and the inner circumference of the cylinder make contact and a second side disposed opposite to the first side and configured to communicate with at least a portion of the suction passage, wherein the first side is longer than the second side, and wherein the suction guide is asymmetrical with respect to a radial direction of the cylinder.

* * * * *